US007245847B2

(12) United States Patent
Takesawa et al.

(10) Patent No.: US 7,245,847 B2
(45) Date of Patent: Jul. 17, 2007

(54) CLEANING APPARATUS FOR A ROTATABLE BRUSH

(75) Inventors: Yoichi Takesawa, Osaka (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 48 days.

(21) Appl. No.: 11/087,986

(22) Filed: Mar. 24, 2005

(65) Prior Publication Data

US 2005/0241092 A1 Nov. 3, 2005

(30) Foreign Application Priority Data

Mar. 26, 2004 (JP) ..... 2004-092334
Mar. 30, 2004 (JP) ..... 2004-099906
Mar. 30, 2004 (JP) ..... 2004-099907

(51) Int. Cl.
*G03G 15/02* (2006.01)

(52) U.S. Cl. ..... 399/100; 399/175

(58) Field of Classification Search ..... 399/175, 399/353, 354, 100
See application file for complete search history.

(56) References Cited

U.S. PATENT DOCUMENTS 5,633,701 A * 5/1997 Yoshida ..... 399/175
6,173,142 B1 * 1/2001 Kawakami ..... 399/175
2003/0039483 A1 * 2/2003 Funabashi ..... 399/100
2004/0179863 A1 * 9/2004 Hatakeyama ..... 399/175

FOREIGN PATENT DOCUMENTS

JP 9-43937 A 2/1997
JP 10-282854 A 10/1998
JP 2000-187373 A 7/2000
JP 2000-342336 A 12/2000
JP 2001201923 A * 7/2001
JP 2001-255719 A 9/2001

* cited by examiner

*Primary Examiner*—David M. Gray
*Assistant Examiner*—Laura K Roth
(74) *Attorney, Agent, or Firm*—Birch, Stewart, Kolasch & Birch, LLP

(57) ABSTRACT

A cleaning apparatus for a rotatable brush that contacts upon or slides along a carrier of electrostatic latent images in order to apply an electric potential to the carrier of the electrostatic latent images, includes, an elastic foam body pressed by the bristles of the rotating brush provided downstream in a direction of a rotation of the rotating brush from a position of contact with the carrier of the electrostatic latent images, and a slide member pressed by the bristles of the rotating brush downstream in the direction of the rotation of the rotating brush from the elastic foam body, wherein the elastic foam body has a contact face that presses the rotatable brush, a discharge face that discharges developer or the like that enters the elastic foam body, and all faces other than the contact face and the discharge face are sealed.

4 Claims, 16 Drawing Sheets

(a)

(b)

CLEANING APPARATUS FOR A ROTATABLE BRUSH

CROSS REFERENCE TO RELATED APPLICATIONS

This application claims priority under 35 U.S.C. §119(a) on Patent Application No. 2004-92334 filed in Japan on Mar. 26, 2004, and on Patent Application Nos. 2004-99906 and 2004-99907 filed in Japan on Mar. 30, 2004, the entire contents of which are hereby incorporated by reference.

BACKGROUND OF THE INVENTION

1. Field of the Invention

The present invention relates to a method for manufacturing a cylindrical rotatable brush having a plurality of bristles provided around a center of rotation, a rotatable brush, a charging apparatus using the rotatable brush, an image forming apparatus using the rotatable brush, and a cleaning apparatus for a rotatable brush used in an electrophotographic image forming apparatus.

2. Description of the Related Art

In a known electro photographic image forming apparatus, a photosensitive drum is rotated while a charging apparatus is used to apply a uniform electrostatic charge to a surface of the photosensitive drum, and a light beam is used to scan the surface of the photosensitive drum, thereby forming an electrostatic latent image on the photosensitive drum. A developer is applied to the electrostatic latent image upon the photosensitive drum, thus forming a development image upon the photosensitive drum, the development image is transferred from the photosensitive drum to a recording paper and the development image on the recording paper is fixed by heat and pressure.

Here, the charging apparatus may be one wherein the charge is applied by corona discharge, or one wherein the charge is applied by contact with a brush. With the former corona-discharge type of charging apparatus, the charge is applied to the photosensitive drum in a non-contact manner, so it has an advantage in that the charge on the photosensitive drum surface is uniform. However, it also has a drawback in that it generates large amounts of ozone. On the other hand, with the latter brush-contact type of charging apparatus, a brush to which a bias voltage is applied is brought into contact with the surface of the photosensitive drum, thus applying a charge to the photosensitive drum, and this has an advantage in that virtually no ozone is generated.

For example, in JP 2000-187373A (hereinafter referred to as "Patent Document 1"), the bristles of the rotatable brush are crimped so that they are inclined and the photosensitive drum and rotatable brush are rotated in directions opposite each other so that the charge is applied to the photosensitive drum while their outside edges are moving in the same direction in the areas of brush contact.

However, conventional charging brushes include a metal core around which a brush cloth embedded with a plurality of bristles is wrapped directly, or a metal core with a plurality of bristles electrostatically embedded directly into its periphery. However, the bristles of a rotatable brush are preferably fine and their elasticity is low. For this reason, if a rotatable brush is pressed firmly against the photosensitive drum, then the bristles of the rotatable brush are easily crimped so that the bristles of the rotatable brush no longer achieve uniform contact with the surface of the photosensitive drum. But if the rotatable brush only contacts lightly against the photosensitive drum, the bristles of the rotatable brush again do not achieve uniform contact with the surface of the photosensitive drum. Thus, it had been difficult to apply a uniform charge to the surface of a photosensitive drum with a rotatable brush.

Moreover, such problems with rotatable brushes occur not only with brushes used to apply a charge but also discharge brushes used to make contact with and discharge a photosensitive drum or the like, and also cleaning brushes used to make contact with and clean a photosensitive drum or the like.

The present invention has been devised in consideration of these issues, and provides a method for manufacturing a cylindrical rotatable brush, a rotatable brush, a charging apparatus using a rotatable brush, an image forming apparatus using a rotatable brush, and a cleaning apparatus for a rotatable brush by which it is possible to prevent the disturbance of the bristles of the rotatable brush.

SUMMARY OF THE INVENTION

In order to solve these problems, the rotatable brush manufacturing method according to the present invention is a method for manufacturing a cylindrical rotatable brush having a plurality of bristles provided around a center of a rotation comprising: a surface covering step wherein a peripheral surface of an elastic foam material provided around a core is coated with a smooth material, and an electrostatic flocking step wherein the plurality of bristles is electrostatically embedded into a surface of the smooth material.

With the rotatable brush manufacturing method according to the present invention, the peripheral surface of the elastic foam material provided around the core is coated with the smooth material, and the plurality of bristles is electrostatically embedded into the surface of the smooth material. Accordingly, the rotatable brush includes the core, the elastic foam material, the smooth material and the bristle-embedded layer including the plurality of embedded bristles superimposed in a concentric manner. When this rotatable brush is pressed against a carrier of electrostatic latent images (e.g., a photosensitive drum), not only the bristles of the charging brush but also the elastic foam material also deforms elastically. Because of this elastic deformation of the elastic foam material, the bristles of the charging brush deform more flexibly and contact the surface of the photosensitive drum more uniformly than when no elastic foam material is present. In addition, the pressure of the plurality of bristles contacting the surface of the carrier of the electrostatic latent images is made uniform, preventing disturbance to the lie of bristles. Moreover, even if the bristles of the charging brush become crimped, recovery from this crimping occurs faster. Were there no elastic foam material, this recovery from crimping may take half a day, but if the elastic foam material is present, this recovery from crimping takes less than 10 minutes. For this reason, when the rotatable brush is used to charge a carrier of the electrostatic latent images, the surface of the carrier of the electrostatic latent images is charged uniformly. In addition, when the rotatable brush is used to discharge or clean a carrier of the electrostatic latent images, the surface of the carrier of the electrostatic latent images is discharged or cleaned uniformly.

In this method, the plurality of bristles electrostatically embedded into the surface of the smooth material may have a certain direction of inclination with respect to the surface.

In this case, the plurality of bristles has a certain direction of inclination with respect to the surface, and the orientations of the plurality of bristles are aligned. Thereby also, the bristles of the rotatable brush make uniform contact with the carrier of the electrostatic latent images, so the surface of the carrier of the electrostatic latent images can be charged, discharged or cleaned uniformly.

Were a plurality of bristles to be electrostatically embedded directly into the surface of the elastic foam material, then the plurality of bristles would be embedded directly into the minute concavity and convexity in the surface of the elastic foam material, so unevenness will occur in the heights of the plurality of bristles from the surface of the elastic foam material. In this case, the bristles of the rotatable brush would not make uniform contact with the carrier of the electrostatic latent images, so charging, discharging or cleaning the surface of the carrier of the electrostatic latent images uniformly would become impossible.

Moreover, the smooth material is interposed between the bristle-embedded layer and the elastic foam material, so any developer that may become attached to the bristles of the bristle-embedded layer is blocked by the smooth material and prevented from intruding into the elastic foam material.

Were there no smooth material, developer attached to the bristles of the bristle-embedded layer would intrude into the elastic foam material, eliminating the elasticity of the elastic foam material, so the function and meritorious effects due to the elasticity of the elastic foam material described above would not be achieved.

In this method, the smooth material may be a conductive adhesive applied to the peripheral surface of the elastic foam material.

In this case, an electrical conduction can be achieved between the smooth material and the bristle-embedded layer, simplifying charging and discharging with the rotatable brush.

In this method, the smooth material may be a sheet that covers the peripheral surface of the elastic foam material.

In this case, a smooth surface can be easily obtained on the periphery of the elastic foam material. This sheet may be in the form of a tube or a planar shape. In addition, if the sheet is conductive, then an electrical conduction can be achieved between the smooth material and the bristle-embedded layer, simplifying charging and discharging with the rotatable brush.

In this method, the smooth material may have a certain resistance, and electricity can pass from the smooth material to the plurality of bristles.

In this method, the smooth material may be conducted into the core to be conductive, and electricity can pass from the core via the smooth material to the plurality of bristles.

In addition, in order to solve the aforementioned problems, a rotatable brush manufacturing method according to the present invention is a method for manufacturing a cylindrical rotatable brush having a plurality of bristles provided around a center of a rotation comprising: an application step wherein a brush cloth embedded with the plurality of bristles is applied to a periphery of a tube, and an insertion step wherein an elastic material provided around a core is inserted into an interior of the tube to which the brush cloth was applied.

With the rotatable brush manufacturing method according to the present invention, the brush cloth embedded with the plurality of bristles is applied to the periphery of the tube, and the elastic material provided around the core is inserted into the interior of the tube to which the brush cloth was applied. Accordingly, the rotatable brush includes the core, the elastic foam material, the tube and the brush cloth superimposed in a concentric manner. When this rotatable brush is pressed against a carrier of electrostatic latent images (e.g., a photosensitive drum), not only the bristles of the charging brush but also the elastic foam material also deforms elastically. Because of this elastic deformation of the elastic foam material, the bristles of the charging brush deform more flexibly and contact the surface of the photosensitive drum more uniformly than when no elastic foam material is present. In addition, the pressure of the plurality of bristles contacting the surface of the carrier of the electrostatic latent images is made uniform, preventing disturbance to the lie of bristles. Moreover, even if the bristles of the charging brush become crimped, recovery from this crimping occurs faster. Were there no elastic foam material, this recovery from crimping may take half a day, but if the elastic foam material is present, this recovery from crimping takes less than 10 minutes. For this reason, when the rotatable brush is used to charge a carrier of the electrostatic latent images, the surface of the carrier of the electrostatic latent images is charged uniformly. In addition, when the rotatable brush is used to discharge or clean a carrier of the electrostatic latent images, the surface of the carrier of the electrostatic latent images is discharged or cleaned uniformly.

In addition, the elastic material provided around the rotating shaft is inserted into the inside of the tube, so the elastic material is uniformly tightened by the tube. For this reason, the surface of the elastic material assumes a smooth cylindrical shape and the contour surface of the rotatable brush also assumes a smooth cylindrical shape. Thereby also, the bristles of the rotatable brush will make uniform contact with the carrier of the electrostatic latent images, so the surface of the carrier of the electrostatic latent images can be uniformly charged, discharged, cleaned or the like.

Were the brush cloth to be wound directly onto the elastic material provided around the core, the elastic material would elastically deform during winding with the brush cloth, causing concavity and convexity in the surface of the elastic material, and concavity and convexity in the contour surface of the rotatable brush also. In this case, the bristles of the rotatable brush would not make uniform contact with the carrier of electrostatic latent images, so it would become impossible for the surface of the carrier of electrostatic latent images to be uniformly charged, discharged, cleaned or the like.

Moreover, the tube is interposed between the brush cloth and the elastic foam material, so any developer that may become attached to the brush cloth is blocked by the smooth material and prevented from intruding into the elastic foam material.

Were there no tube, developer attached to the brush cloth would intrude into the elastic foam material, eliminating the elasticity of the elastic foam material, so the function and meritorious effects due to the elasticity of the elastic foam material described above would not be achieved.

In this method, in the application step, a cylindrical member may be inserted into the interior of the tube, and the brush cloth may be applied to the periphery of the tube in the state in which the tube is kept in its cylindrical shape by the cylindrical member. For example, the tube may be kept in its cylindrical shape by inserting the cylindrical member into the interior of the tube and heat shrinking the tube until it is tightly adhered to the cylindrical member. Alternately, the cylindrical member may have a variable outside diameter, and the tube may be kept in its cylindrical shape by increasing the outside diameter of the cylindrical member inserted into the interior of the tube until the tube is tightly adhered to the cylindrical member. Thereby, the brush cloth can be reliably applied to the periphery of the tube.

In this method, the brush cloth is shaped to a strip, and in the application step, the strip-shaped brush cloth may be applied to the periphery of the tube by winding in a spiral manner.

In this case, because the strip-shaped brush cloth is wound in a spiral manner, the seams in the brush cloth are also spiral in shape. For this reason, when the bristles of the rotatable brush are put in contact with the carrier of the electrostatic latent images with the rotatable brush and carrier of the electrostatic latent images rotating, the effects of the seams in the brush cloth do not readily appear in the surface of the carrier of the electrostatic latent images.

In this method, in the application step, the brush cloth may be applied to the periphery of the tube with a conductive adhesive interposed therebetween.

In this case, an electrical conduction can be achieved between the smooth material and the bristle-embedded layer, simplifying charging and discharging with the rotatable brush.

In this method, in the insertion step, the elastic material provided around the core may be pressed into the interior of the tube to which the brush cloth was applied.

In this case, the elastic material is tightly adhered to the tube, so there is no need for the tube to be adhered to the elastic material with adhesive.

Were the tube to be adhered to the elastic material with adhesive, the adhesive would be absorbed into the fine concavity and convexity in the surface of the elastic material, so adequate adhesive strength would not be obtained. In addition, were large amounts of adhesive to be used, the absorption of adhesive on the surface of the elastic material would eliminate the elasticity of the elastic material, so the function and meritorious effects due to the elasticity of the elastic material described above would not be achieved.

This method may further comprise a step wherein, after the rotatable brush is formed, the rotatable brush is rotated and also the plurality of bristles of the rotatable brush is heated while the bristles of the rotatable brush are aligned in one direction.

In this manner, the bristles of the rotatable brush may be given a crimp so that they incline.

In addition, in order to solve the aforementioned problems, a rotatable brush according to the present invention is a cylindrical rotatable brush having a plurality of bristles provided around a center of rotation, comprising: a core, an elastic foam material provided around the core, a smooth material that covers a peripheral surface of the elastic foam material, and the plurality of bristles embedded into the surface of the smooth material.

In addition, in order to solve the aforementioned problems, another rotatable brush according to the present invention is a cylindrical rotatable brush having a plurality of bristles provided around a center of rotation, comprising: a core, an elastic foam material provided around the core, a tube that covers a peripheral surface of the elastic foam material, and a brush cloth embedded with a plurality of bristles that is applied to the periphery of the tube.

In addition, in order to solve the aforementioned problems, a charging apparatus according to the present invention is a charging apparatus wherein the rotatable brush according to the present invention is used to charge a carrier of electrostatic latent images.

In addition, in order to solve the aforementioned problems, an image forming apparatus according to the present invention is an image forming apparatus that uses the rotatable brush according to the present invention.

With the rotatable brush, a charging apparatus using same and an image forming apparatus according to the present invention as described above, the same functions and meritorious effects can be achieved as with the rotatable brush manufacturing method according to the present invention described above.

In addition, in order to solve the aforementioned problems, a cleaning apparatus for a rotatable brush according to the present invention is a cleaning apparatus for a rotatable brush that contacts upon or slides along a carrier of electrostatic latent images in order to apply an electric potential to the carrier of the electrostatic latent images, comprising: an elastic foam body that is pressed by the bristles of the rotating brush downstream in a direction of a rotation of the rotating brush from a position of contact with the carrier of the electrostatic latent images, and a slide member that is pressed by the bristles of the rotating brush downstream in the direction of the rotation of the rotating brush from the elastic foam body.

In the cleaning apparatus according to the present invention, the elastic foam material that the rotatable brush presses is provided downstream in the direction of the rotation of the charging brush from the position of contact between the charging brush and the surface of the carrier of the electrostatic latent images. A large number of small holes is formed in the surface of this elastic foam body, and when the bristles of the rotatable brush press this elastic foam body, any developer or other fouling material adhering to the plurality of brushes of the rotatable brush is removed, and moreover the developer or other fouling material passes through the small holes and is absorbed into the interior of the elastic foam body. Thus, developer or other fouling material adhering to the bristles of the rotatable brush is reliably removed, thus preventing uneven charging or even damage to the carrier of the electrostatic latent images caused by developer or other fouling material adhering to the bristles of the rotatable brush.

However, when the bristles of the rotatable brush press the elastic foam body, the orientations of the bristles of the rotatable brush are disturbed. To solve this problem, with the cleaning apparatus of the present invention, a slide member that is pressed by the bristles of the rotating brush is provided downstream in the direction of rotation of the rotating brush from the elastic foam body. This slide member aligns in a certain direction the bristles of the rotatable brush that press it. Thus, it is possible to prevent uneven charging of the carrier of the electrostatic latent images caused by disturbance in the orientation of the bristles of the rotatable brush.

Accordingly, the elastic foam body presses the bristles of the rotatable brush and removes any developer or other fouling material adhering to the bristles of the rotatable brush, and the bristles of the rotatable brush disturbed at this time then press the slide member to align the bristles of the brush in the certain direction. Thus, uneven charging of the surface of the carrier of the electrostatic latent images caused by developer or other fouling material adhering to the bristles of the rotatable brush is prevented, and uneven charging of the surface of the carrier of the electrostatic latent images due to disturbance in the orientation of the bristles of the rotatable brush does not occur.

In the aforementioned constitution, specifically, the slide member may have a smooth surface so that the orientations of the bristles of the rotatable brush are aligned by the bristles of the rotatable brush pressing this smooth surface.

In the aforementioned constitution, the elastic foam body may be an elastic foam body with connected bubbles.

In this case, the elastic foam body with connected bubbles is used as the elastic foam body. With this elastic foam body with connected bubbles, the small holes formed by the connected bubbles are connected, so developer and other fouling material quickly passes through the small holes so even more developer and other fouling material can be absorbed.

In the aforementioned constitution, the elastic foam body may have a contact face that presses the rotatable brush, a discharge face that discharges developer or the like that enters the elastic foam body, and all other faces that are sealed.

In this case, all of the faces of the elastic foam body other than a contact face that presses the rotatable brush and a discharge face that discharges developer or the like that enters the elastic foam body are sealed, so developer and other fouling material adhering to the bristles of the rotatable brush is absorbed from the contact surface of the elastic foam body, passes through the small holes in the elastic foam body and is furthermore discharged from the discharge face of the elastic foam body. Thereby, large amounts of developer and other fouling material can be removed from the bristles of the rotatable brush.

In the aforementioned constitution, the rotatable brush may contact the bottom surface of the carrier of the electrostatic latent images.

In this case, developer and other fouling material from the charging brush does not go against the force of gravity and is removed by the small holes of the elastic foam material, and thus developer and other fouling material passes through the small holes and flows downward toward the discharge face, thereby increasing the efficiency of removal of fouling material.

DETAILED DESCRIPTION OF THE INVENTION

Hereinafter, embodiments of the present invention will be described in detail with reference to the accompanying drawings.

EMBODIMENT 1

Figure 1:
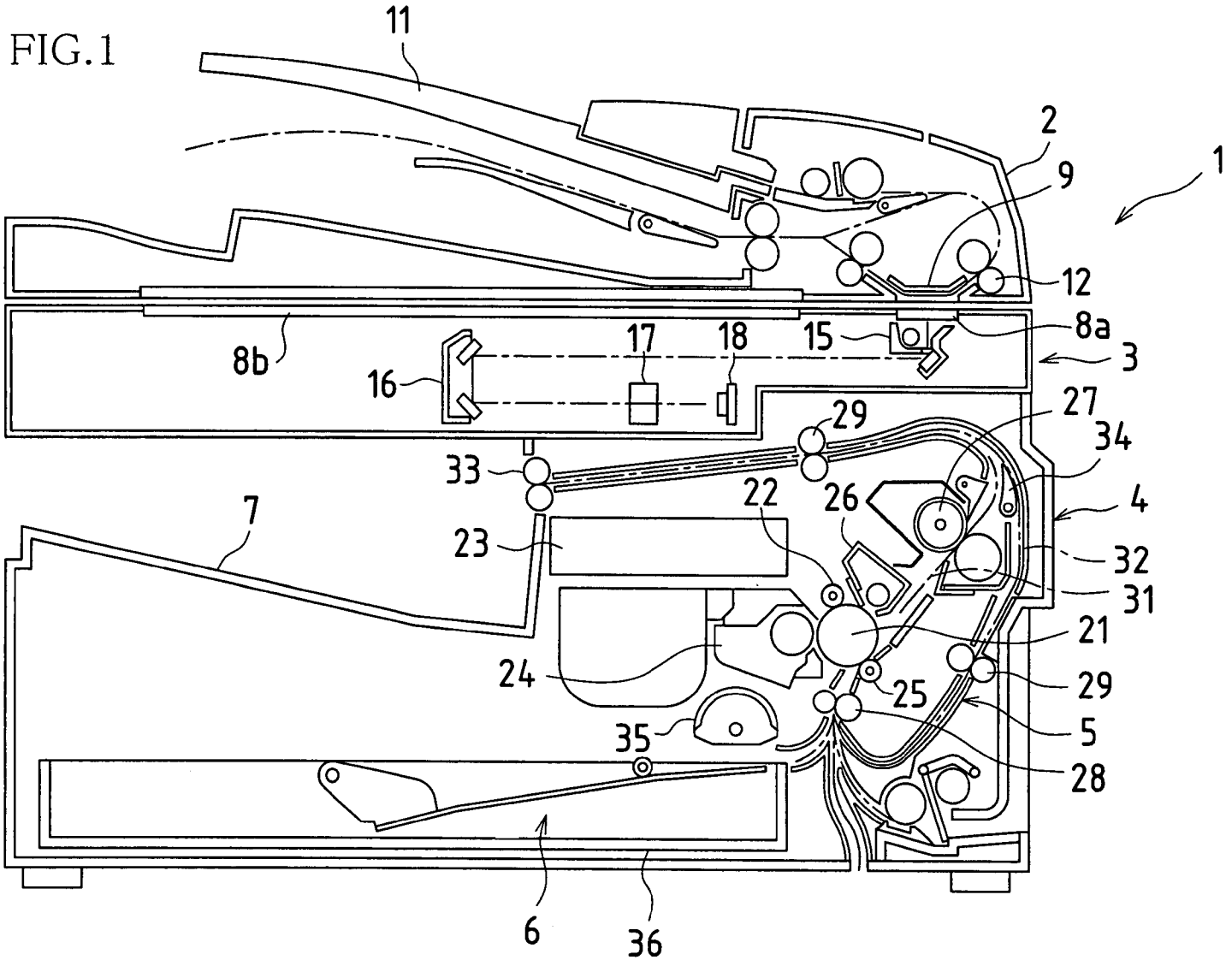
FIG. 1 is a side view showing an image forming apparatus according to Embodiment 1 of the present invention.

FIG. 1 is a side view showing an image forming apparatus according to Embodiment 1 of the present invention. This image forming apparatus 1 is provided with an original carrying unit 2, original reading apparatus 3, printing unit 4, recording paper carrying unit 5, paper-supply unit 6 and paper-discharge tray 7.

In the original carrying unit 2, when at least one original is loaded into an original loading tray 11, the originals are picked up and carried one sheet at a time from the original loading tray 11, and when the leading edge of an original reaches paper separation (PS) rollers 12, the carrying of the original is temporarily halted with the leading edge of the original brought parallel to the PS rollers 12. Then, after reaching synchronization with the image recording operation of the printing unit 4, a clutch between the PS rollers 12 and a driveshaft is engaged, driving the PS rollers 12 to rotate so that the original is again carried by the PS rollers 12 and the original is passed between platen glass 8*a* and an original presser plate 9.

In the original reading apparatus 3, when an original is carried in, the original is exposed with a first scanning unit 15, the light reflected from the original is guided to an imaging lens 17 by the first and second scanning units 15 and 16, so that an image of the original is formed by the imaging lens 17 upon a photoelectric transducer element (hereinafter referred to as a CCD) 18. The CCD 18 repeatedly scans over the original in the main scanning direction, thus reading and providing output of image data representing the original.

In addition, when an original is placed on a platen glass 8*b*, first and second scanning units 15 and 16 move such that a predetermined speed relative to each other is maintained, and while the original on the platen glass 8*b* is exposed with the first scanning unit 15, the light reflected from the original is guided to an imaging lens 17 by the first and second scanning units 15 and 16, so that an image of the original is formed by the imaging lens 17 upon the CCD 18.

The image data output by the CCD 18 is subjected to various types of image processing under the control of a microcomputer or other type of control circuit and then output to the printing unit 4.

The printing unit 4 is used to record the image of the original represented by image data onto recording paper, being provided with a photosensitive drum 21, brush-based charging apparatus 22, laser scan unit (hereinafter abbreviated LSU) 23, developing unit 24, transfer unit 25, cleaning unit 26, discharging unit (not shown), a fixing unit 27 and other components. The photosensitive drum 21 rotates in one direction as its surface is cleaned by the cleaning unit 26 and the discharging unit, and then its surface is charged uniformly by the brush-based charging apparatus 22. The LSU 23 modulates a laser beam based on the image data, and this laser beam is used to repeatedly scan over the surface of the photosensitive drum 21 in the main scanning direction, thus forming an electrostatic latent image on the surface of the photosensitive drum 21. The developing unit 24 supplies toner to the surface of the photosensitive drum 21 to develop the electrostatic latent image and thus form a visible image in toner on the surface of the photosensitive drum 21. The transfer unit 25 transfers the visible toner image from the surface of the photosensitive drum 21 to recording paper that is carried in by the recording paper carrying unit 5. The fixing unit 27 applies heat and pressure to the recording paper in order to fix the visible toner image upon the recording paper. Thereafter, the recording paper is further carried by the recording paper carrying unit 5 to the paper-discharge tray 7 and discharged.

In order to carry recording paper, the recording paper carrying unit 5 is provided with PS rollers 28, carry rollers 29, a carrying path 31, reversing carrying path 32, paper-discharge rollers 33, branching gate 34 and other components. In the carrying path 31, recording paper is received from the paper-supply unit 6, and when the leading edge of the recording paper reaches the PS rollers 28, the carrying of the original is temporarily halted with the leading edge of the recording paper brought parallel to the PS rollers 28. Thereafter, the recording paper is carried by PS rollers 28 to the transfer unit 25 of the printing unit 4, and moreover the recording paper is carried to the paper-discharge tray 7. In addition, when an image is also to be recorded on the back side of the recording paper, the branching gate 34 is rotated and moved to switch to the branch of carrying path 31 and the reversing carrying path 32, so that the recording paper is carried in the opposite direction from the carrying path 31 to the reversing carrying path 32. In the reversing carrying path 32, when recording paper is received from the carrying path 31, the recording paper is reversed back to front and then the recording paper is returned to the PS rollers 28 of the carrying path 31. Thereby, an image is also recorded on the back surface of the recording paper. Upon these carrying paths 31 and 32 are disposed a plurality of detector switches for detecting the passage of the recording paper, and control of the timing of carrying recording paper and the like is conducted based on detection by the various detector switches.

The paper-supply unit 6 holds unused recording paper and is used to supply this unused recording paper to the recording paper carrying unit 5, being provided with a paper-supply cassette 36. The paper-supply cassette 36 holds stacked recording paper, so a half-moon-shaped pickup roller 35 is used to pick up and carry recording paper one sheet at a time. Moreover, the recording paper is picked up from the paper-supply cassette 36 and carried to the PS rollers 28.

Figure 2:
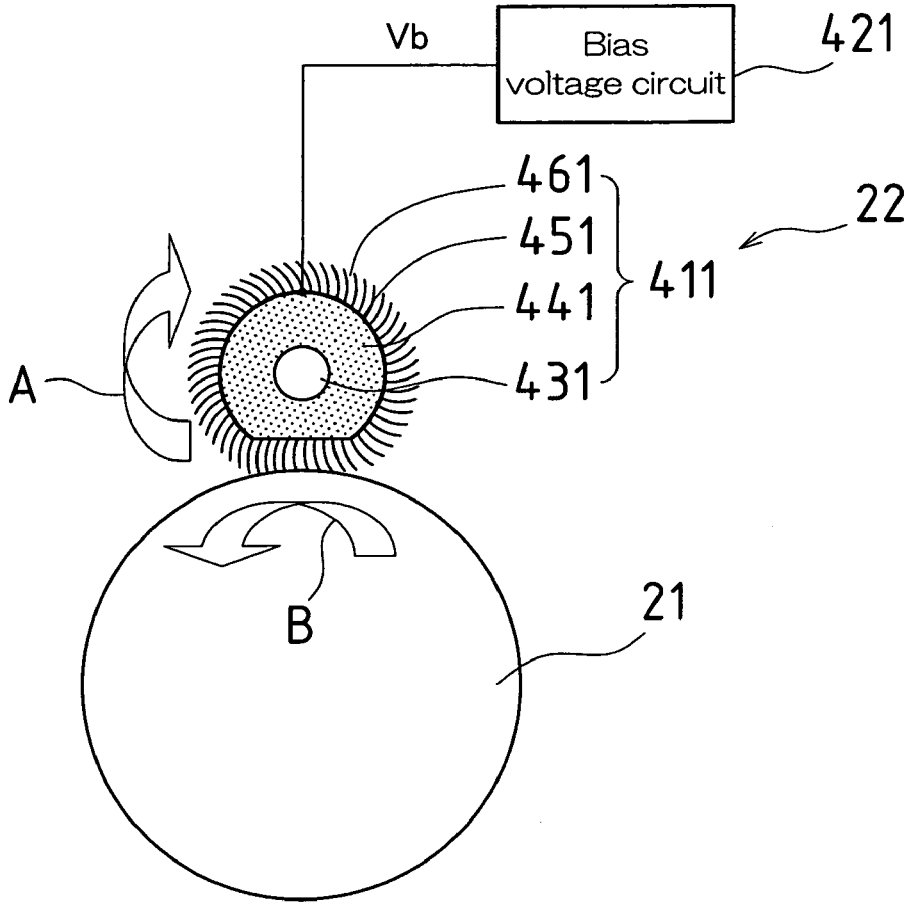
FIG. 2 is a side view showing a brush-based charging apparatus in the image forming apparatus of FIG. 1 in accordance with Embodiment 1.

Here follows a more detailed description of the brush-based charging apparatus 22. FIG. 2 is a side view showing the brush-based charging apparatus 22. In this brush-based charging apparatus 22, the bias voltage $V_b$ of a bias voltage circuit 421 is applied to a charging brush 411, and the charging brush 411 presses the surface of the photosensitive drum 21 while the charging brush 411 and photosensitive drum 21 are rotated in the respective directions indicated by the arrows A and B at the same circumferential speed, and thus a charge is applied to the surface of the photosensitive drum 21.

The charging brush 411 includes a rotating shaft 431 around which is provided elastic foam material 441, the outside surface of the elastic foam material 441 is covered with smooth material 451, and a bristle-embedded layer 461 formed by electrostatically embedding a plurality of bristles is provided in the surface of the smooth material 451. Thus, the rotating shaft 431, elastic foam material 441, smooth material 451 and bristle-embedded layer 461 are provided concentrically. The rotating shaft 431 is made of metal, and the elastic foam material 441, smooth material 451 and bristle-embedded layer 461 are conductive. Accordingly, the bias voltage $V_b$ of the bias voltage circuit 421 can be applied to the bristle-embedded layer 461 through the rotating shaft 431, elastic foam material 441 and smooth material 451.

Figure 3:
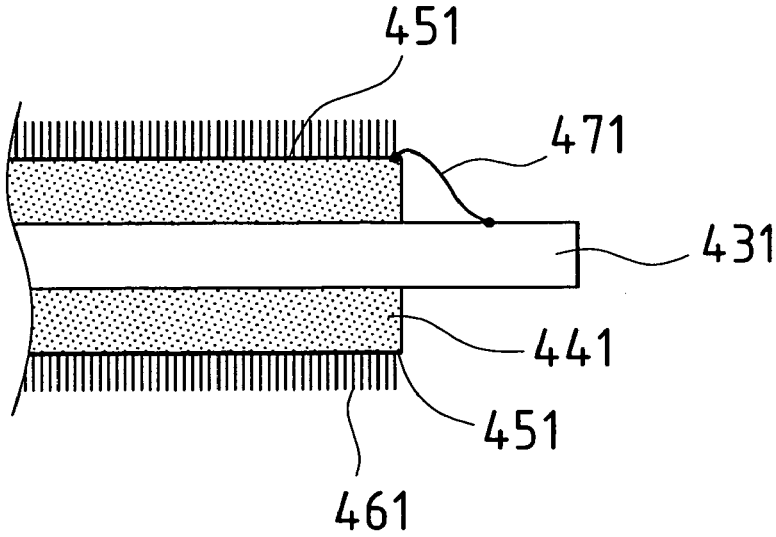
FIG. 3 is a diagram of a modification of the charging brush of the brush-based charging apparatus of FIG. 2.

Note that as shown in FIG. 3, the smooth material 451 may be connected to the rotating shaft 431 via conducting material 471, so that the bias voltage $V_b$ of the bias voltage circuit 421 can be applied to the bristle-embedded layer 461 via the rotating shaft 431, conducting material 471 and smooth material 451. In this case, there is no need for the elastic foam material 441 to be conductive.

The bias voltage $V_b$ applied by the bias voltage circuit 421 to the charging brush 411 may be a DC voltage or a DC voltage overlaid with an AC voltage.

When a DC bias voltage $V_b$ is used, the amount of ozone generated may be reduced.

In addition, when a bias voltage $V_b$ consisting of a DC voltage overlaid with an AC voltage is used, while the amount of ozone generated increases, it is possible to suppress unevenness in the charge on the surface of the photosensitive drum 21. This is because even when a rapid injection of charge occurs from the tip of a bristle of the charging brush 411 to the photosensitive drum 21, the midsections of the other bristles of the charging brush 411 make contact with the location of the rapid injection of charge, and the excess charge in this location is discharged due to the application of AC voltage from the other bristles, thus causing the potential at this location to become equal to the potential of the surroundings. The amplitude voltage of the AC voltage is preferably about twice the DC voltage or greater.

Figure 4:
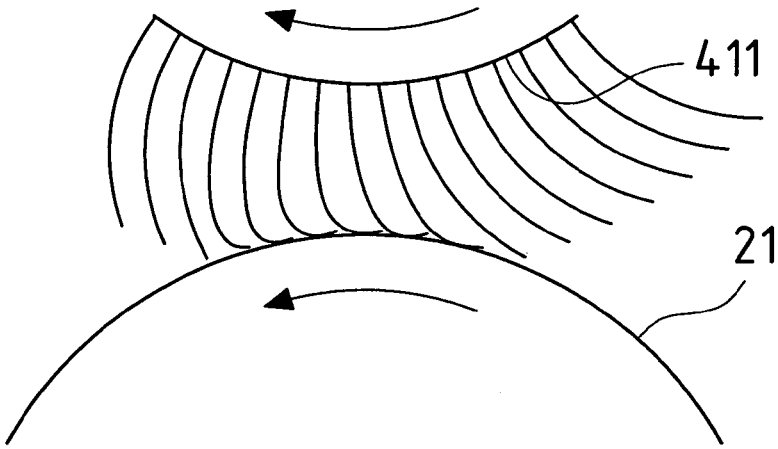
FIG. 4 is an enlarged side view showing the state of contact between the charging brush and the photosensitive drum in the brush-based charging apparatus of FIG. 2.

Here, when the charging brush 411 presses against the surface of the photosensitive drum 21 while the charging brush 411 and photosensitive drum 21 are rotated in the respective directions indicated by the arrows A and B at the same circumferential speed, in the area of contact between the charging brush 411 and the photosensitive drum 21, the periphery of the charging brush 411 and the periphery of the photosensitive drum 21 are both moving in the same direction at the same speed. The bristles of the charging brush 411 have their orientation of inclination set so that their grain is in the direction of rotation of the surface of the photosensitive drum 21. For this reason, as shown in FIG. 4, the tips of the bristles of the charging brush 411 do not strike the surface of the photosensitive drum 21 straight on, but rather the midsections of the bristles of the charging brush 411 glide over the surface of the photosensitive drum 21. Moreover, the charging brush 411 contacts only the photosensitive drum 21 and does not make contact with other objects.

Thereby, disturbance of the charging brush 411 due to the tips of its bristles striking the surface of the photosensitive drum 21 straight on is prevented, and the bristles of the charging brush 411 glide over the surface of the photosensitive drum 21 and stream in the direction of the periphery of the charging brush 411, so the bristles of the charging brush 411 are constantly aligned in the peripheral direction.

If the bristles of the charging brush 411 are constantly aligned in the peripheral direction in this manner, then no disturbances in the lie of the bristles will be reflected as uneven charging of the surface of the photosensitive drum 21, so the surface of the photosensitive drum 21 will be uniformly charged. Were any disturbances in the lie of the bristles of the charging brush to occur, the disturbances in the lie of bristles would be reflected as uneven charging of the surface of the photosensitive drum 21.

In addition, the tips of the bristles of the charging brush 411 do not strike the surface of the photosensitive drum 21 straight on, so no rapid injection of charge occurs from the tips of bristles of the charging brush 411 to the photosensitive drum 21, and thus no unevenness in the charge on the surface of the photosensitive drum 21 due to such rapid injection of charge occurs. Were the tips of the bristles of the charging brush to strike the surface of the photosensitive drum 21 straight on, a rapid injection of charge would occur from the tips of bristles of the charging brush to the surface of the photosensitive drum 21, causing unevenness in the charge on the surface of the photosensitive drum 21.

Figure 5:
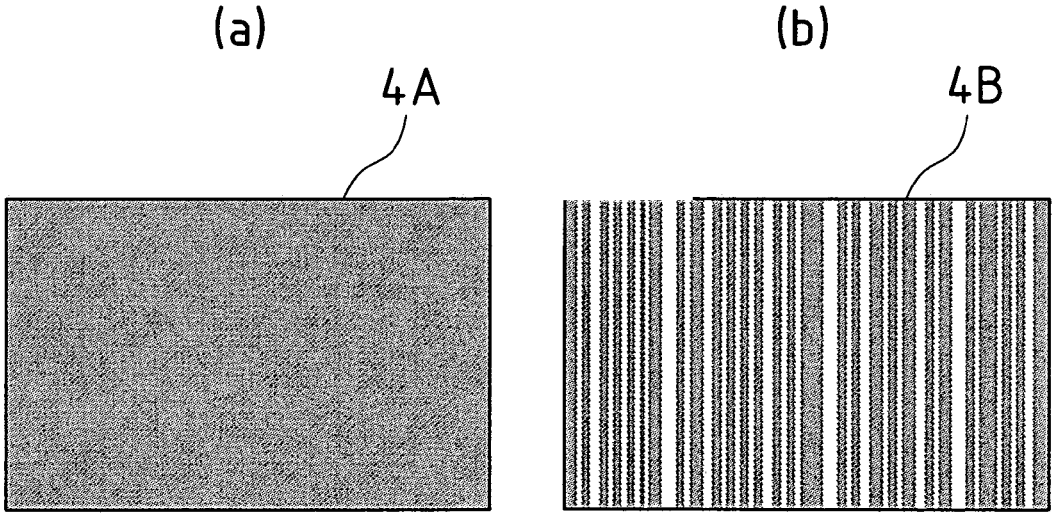
FIG. 5(*a*) and FIG. 5(*b*) are diagrams illustrating a comparison between a gray image formed using the brush-based charging apparatus of FIG. 2 and a gray image formed using a comparative example of a brush-based charging apparatus.

FIG. 5(*a*) and FIG. 5(*b*) are diagrams illustrating a comparison between a gray image 4A with a certain grayscale level recorded in the state wherein the bristles of the charging brush 411 glide along the surface of the photosensitive drum 21 as in this embodiment, and a gray image 4B with a certain grayscale level recorded in the state wherein the bristles of the charging brush strike the surface of the photosensitive drum 21 straight on. As is clear from this comparison, where the gray image 4A according to this embodiment has a uniform grayscale level, a large number of lines appear in gray image 4B. This occurs because the tips of the bristles of the charging brush strike the surface of the photosensitive drum 21 straight on so that charge is injected rapidly from the bristle tips, causing linear unevenness in the charge on the surface of the photosensitive drum 21.

Figure 6:
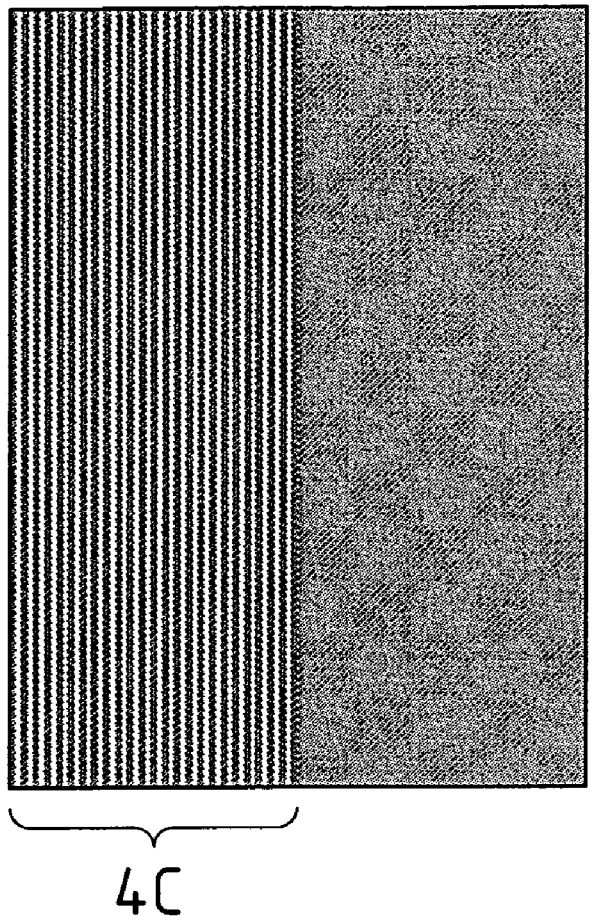
FIG. 6 is a diagram illustrating banding (band-shaped image defects) caused by uneven rotation of the photosensitive drum.

In addition, when the tips or midsections of the bristles of the charging brush 411 glide over the surface of the photosensitive drum 21, the mechanical resistance between the charging brush 411 and the photosensitive drum 21 is low so the bristles of the charging brush 411 and the surface of the photosensitive drum 21 are not readily worn. In addition, the mechanical resistance between the charging brush 411 and the photosensitive drum 21 is low so there is no need to increase the torque to the photosensitive drum 21. For this reason, any unevenness in rotation that may arise from increased torque to the photosensitive drum 21 does not occur, and the banding 4C (band-shaped image defects) as shown in FIG. 6 also does not occur.

Moreover, because elastic foam material 441 is provided around the rotating shaft 431, when the charging brush 411 is pressed against the photosensitive drum 21, not only the bristles of the charging brush 411 but also the elastic foam material 441 also deforms elastically. Because of this elastic deformation of the elastic foam material 441, the bristles of the charging brush 411 deform more flexibly and contact the surface of the photosensitive drum 21 more uniformly than when no elastic foam material 441 is present. Thereby, the surface of the photosensitive drum 21 is charged more evenly.

In addition, because a plurality of bristles is electrostatically embedded to form the bristle-embedded layer 461, there are no seams in the bristle-embedded layer 461. For this reason, no effects due to seams in the bristle-embedded layer 461 appear in the surface of the photosensitive drum 21. Were the charging brush to be formed by wrapping brush cloth, then the seams in the brush cloth may cause unevenness in the charge on the surface of the photosensitive drum 21.

Moreover, not only the bristles of the charging brush 411 but also the elastic foam material 441 also deforms elastically so the pressure of the plurality of bristles making contact with the surface of the photosensitive drum 21 becomes more uniform, thus preventing disturbances in the lie of the bristles. Thereby, a uniform charge continues to be maintained on the surface of the photosensitive drum 21.

In addition, the bristles of the charging brush 411 and the elastic foam material 441 deform together, so the load on the bristles of the charging brush 411 is lessened, reducing the chances of crimping of the bristles of the charging brush 411. Even if the bristles of the charging brush 411 become crimped, recovery from this crimping occurs faster. Were there no elastic foam material 441, this recovery from crimping may take half a day, but if the elastic foam material 441 is present, this recovery from crimping takes less than 10 minutes.

Moreover, the smooth material 451 is interposed between the bristle-embedded layer 461 and the elastic foam material 441, so any developer that may be picked up from the surface of the photosensitive drum 21 by the bristle-embedded layer 461 and become attached to the bristles of the bristle-embedded layer 461 is blocked by the smooth material 451 and prevented from intruding into the elastic foam material 441.

Were there no smooth material 451, developer attached to the bristles of the bristle-embedded layer 461 would intrude into the elastic foam material 441, eliminating the elasticity of the elastic foam material 441, so the function and meritorious effects due to the elasticity of the elastic foam material 441 described above would not be achieved.

Figure 7:
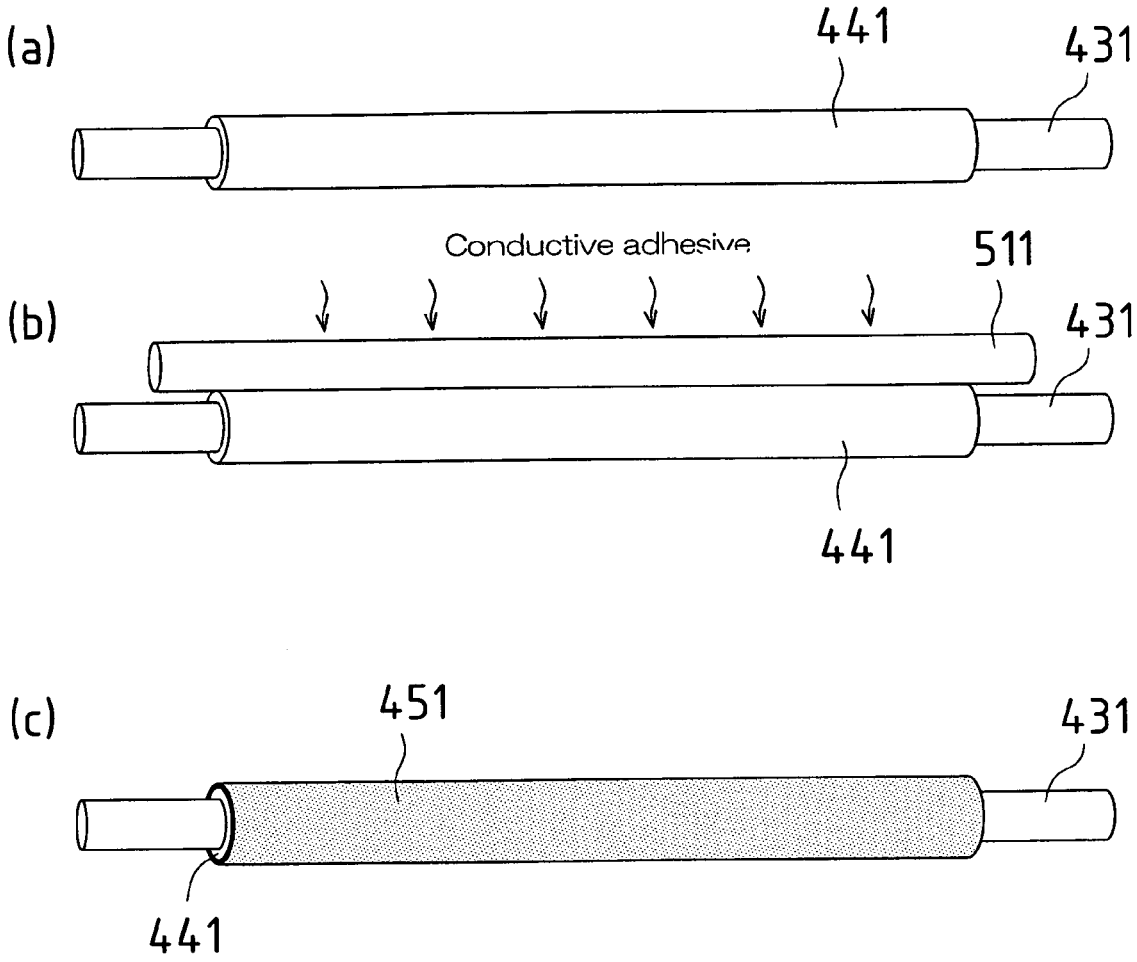
FIG. 7(*a*) through FIG. 7(*c*) are diagrams illustrating the manufacturing process for the charging brush in the brush-based charging apparatus of FIG. 2.
Figure 8:
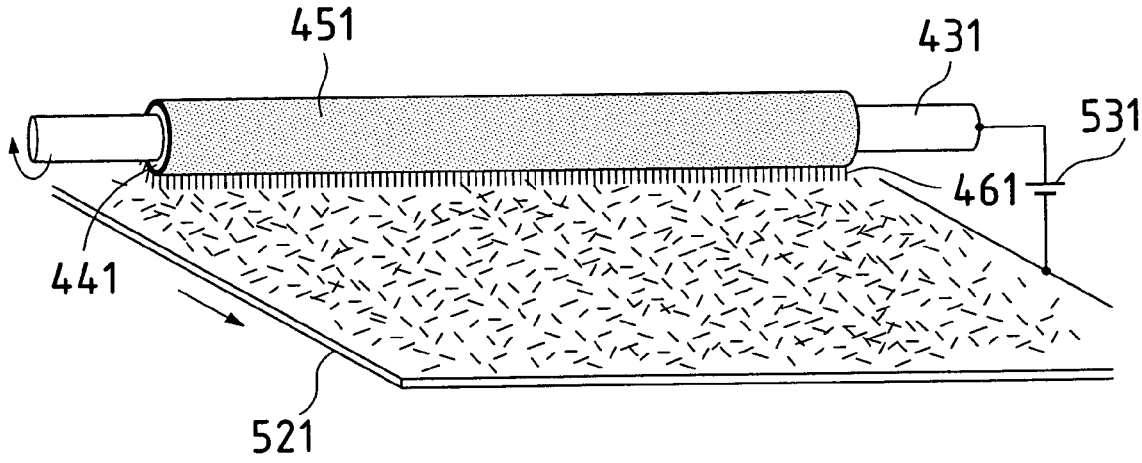
FIG. 8(*a*) and FIG. 8(*b*) are diagrams illustrating the manufacturing process in continuation from FIG. 7.
Figure 8:
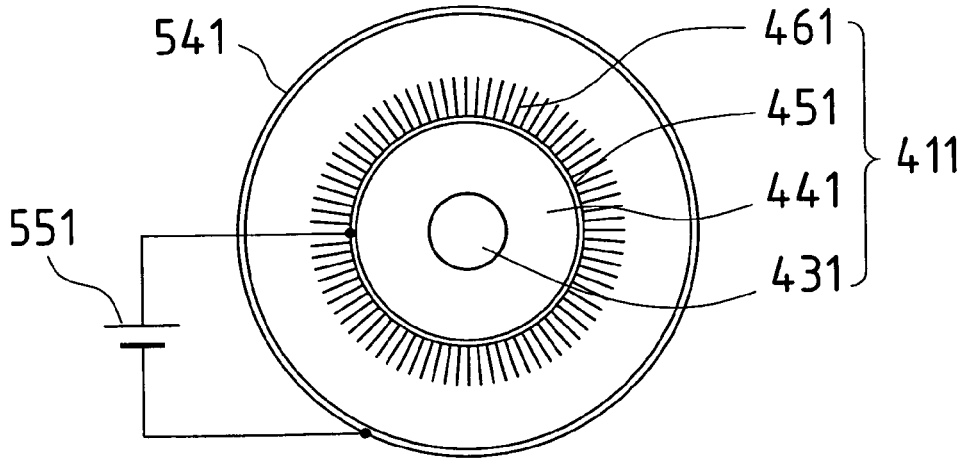

Here follows a description of a method for manufacturing the charging brush 411 made with reference to FIG. 7 and FIG. 8.

First, as shown in FIG. 7(*a*), the periphery of a metal rotating shaft 431 is covered with elastic foam material 441. Then, as shown in FIG. 7(*b*), the elastic foam material 441 is pushed against an application roller 511, and the elastic foam material 441 and application roller 511 are rotated in this state while a liquid conductive adhesive is supplied to the peripheral surface of the application roller 511, so the application roller 511 uniformly applies the liquid conductive adhesive to the peripheral surface of the elastic foam material 441, thus forming the smooth material 451 including a layer of conductive adhesive covering the peripheral surface of the elastic foam material 441 as shown in FIG. 7(*c*).

The elastic foam material 441 is a sponge material made of urethane, EPDM, silicone resin or chloroprene or the like into which conductive particles are mixed. The conductive particles may be conductive carbon black, zinc oxide, aluminum oxide or other metallic powders, ionic conductive metal salts or the like.

The conductive adhesive may be any known adhesive that is suited to adhering the elastic foam material 441 into which particles of the same conductivity as that of the elastic foam material 441 are mixed.

The elastic foam material 441 and the smooth material 451 made of a layer of conductive adhesive are given an appropriate volume resistance (roughly $10^3$–$10^6$ Ω·cm) by adjusting the amount of conductive particles mixed in. This is because, if the resistance of the elastic foam material 441 and the smooth material 451 including a layer of conductive adhesive is too low, the amount of current passing from the charging brush 411 to the photosensitive drum 21 is too great so that abnormal discharges occur between the charging brush 411 and photosensitive drum 21, but if the resistance of the smooth material 451 is too high, the potential of the bristles of the charging brush 411 becomes too low for the surface of the photosensitive drum 21 to be maintained at a certain charge potential.

Next, before the layer of conductive adhesive to become the smooth material 451 hardens, as shown in FIG. 8(*a*), the rotating shaft 431 is placed parallel to a metal plate 521 and separated therefrom by a fixed distance above, the rotating shaft 431 is axially supported and driven to rotate while the smooth material 451 including a layer of conductive adhesive rotates and moves. In addition, a plurality of conductive bristles is placed upon the metal plate 521 and the metal plate 521 is moved gradually in a direction perpendicular to the lengthwise direction of the rotating shaft 431. The smooth material 451 and metal plate 521 move in directions opposite each other in the facing areas. Moreover, the DC voltage of a DC power supply 531 is applied between the rotating shaft 431 and the metal plate 521. The rotating shaft 431, elastic foam material 441 and smooth material 451 are conductive, so the DC voltage of the DC power supply 531 passes through the rotating shaft 431 and elastic foam material 441 and is applied to the smooth material 451, so a static electric field is generated between the smooth material 451 and the metal plate 521.

In this state, the static electric field between the smooth material 451 and the metal plate 521 causes the plurality of bristles upon the metal plate 521 to fly up to the smooth material 451 made of a layer of unhardened conductive adhesive, thus embedding the plurality of bristles vertically into the peripheral surface of the smooth material 451. With the rotation and movement of the smooth material 451 and the movement of the metal plate 521, the embedding of the plurality of bristles continues around the entire circumference of the smooth material 451, thus forming the bristle-embedded layer 461 upon the periphery of the smooth material 451.

Thereafter, as shown in FIG. 8(*b*), the rotating shaft 431 is inserted into the center of a metal cylinder 541, a DC voltage from a DC power supply 551 is applied between the rotating shaft 431 and the metal cylinder 541, thus inducing a radial static electric field between the smooth material 451 and the metal cylinder 541. The conductive adhesive to become the smooth material 451 is hardened in the state in which the bristles of the bristle-embedded layer 461 are kept vertical with respect to the peripheral surface of the smooth material 451 by this radial static electric field. Thus, a charging brush 411 is formed with the bristles of the bristle-embedded layer 461 supported vertically with respect to the peripheral surface of the smooth material 451.

Moreover, the rotating shaft 431 is axially supported and rotated at high speed while the knife edge of a cutter is placed a fixed distance from the peripheral surface of the smooth material 451, so that the knife edge of the cutter strikes each bristle of the rapidly rotating bristle-embedded layer 461 nearly perpendicularly, thus evenly trimming the bristles of the bristle-embedded layer 461. Finally, the charging brush 411 is placed in a cylinder (not shown) and with the charging brush 411 rotating with the bristles of the bristle-embedded layer 461 in contact with the inside wall surface of the cylinder, the inside of the cylinder is heated to thus give the bristles of the bristle-embedded layer 461 a crimp so that each bristle is inclined. Alternately, the rotating shaft 431 may be rotated while the bristles of the bristle-embedded layer 461 are heated while being pressed against a flat surface to give a crimp to the bristles of the bristle-embedded layer 461.

With such a manufacturing method, a plurality of bristles is embedded into the peripheral surface of the smooth material 451, so the plurality of bristles have a certain direction of inclination with respect to its peripheral surface and the orientation of the plurality of bristles is made uniform. Thereby, the bristles of the charging brush 411 will make uniform contact with the photosensitive drum 21, so it is possible to apply a uniform charge to the surface of the photosensitive drum 21.

Were a plurality of bristles to be electrostatically embedded directly into the surface of the elastic foam material 441, then the plurality of bristles would be embedded directly into the minute concavity and convexity in the surface of the elastic foam material 441, so unevenness will occur in the heights of the plurality of bristles from the surface of the elastic foam material 441. In this case, the bristles of the charging brush 411 would not make uniform contact with the photosensitive drum 21, so achieving a uniform charge on the surface of the photosensitive drum 21 would become impossible.

Note that while here, the peripheral surface of the elastic foam material 441 is coated with conductive adhesive that is hardened to form the smooth material 451, but instead, the peripheral surface of the elastic foam material 441 may be coated with conductive adhesive and then a synthetic resin sheet or the like may be wrapped around the periphery of the elastic foam material 441 and the conductive adhesive hardened, thus making this synthetic resin sheet the smooth material, and then coating the peripheral surface of this smooth material with adhesive and performing the electrostatic flocking into the peripheral surface of this smooth material.

Alternately, the elastic foam material 441 may be inserted into a synthetic resin tube with an inside diameter greater than the outside diameter of the elastic foam material 441, and then this synthetic resin tube may be heated to cause heat shrinkage, thus tightly adhering the synthetic resin tube to the peripheral surface of the elastic foam material 441 and making this synthetic resin tube the smooth material, and then coating the peripheral surface of this smooth material with adhesive and performing the electrostatic flocking into the peripheral surface of this smooth material.

When a synthetic resin sheet or synthetic resin tube is used in this manner, it is easy to obtain a smooth surface, and so it is easy to obtain uniform heights and directions for the bristles of the bristle-embedded layer formed on this smooth peripheral surface.

EMBODIMENT 2

Figure 9:
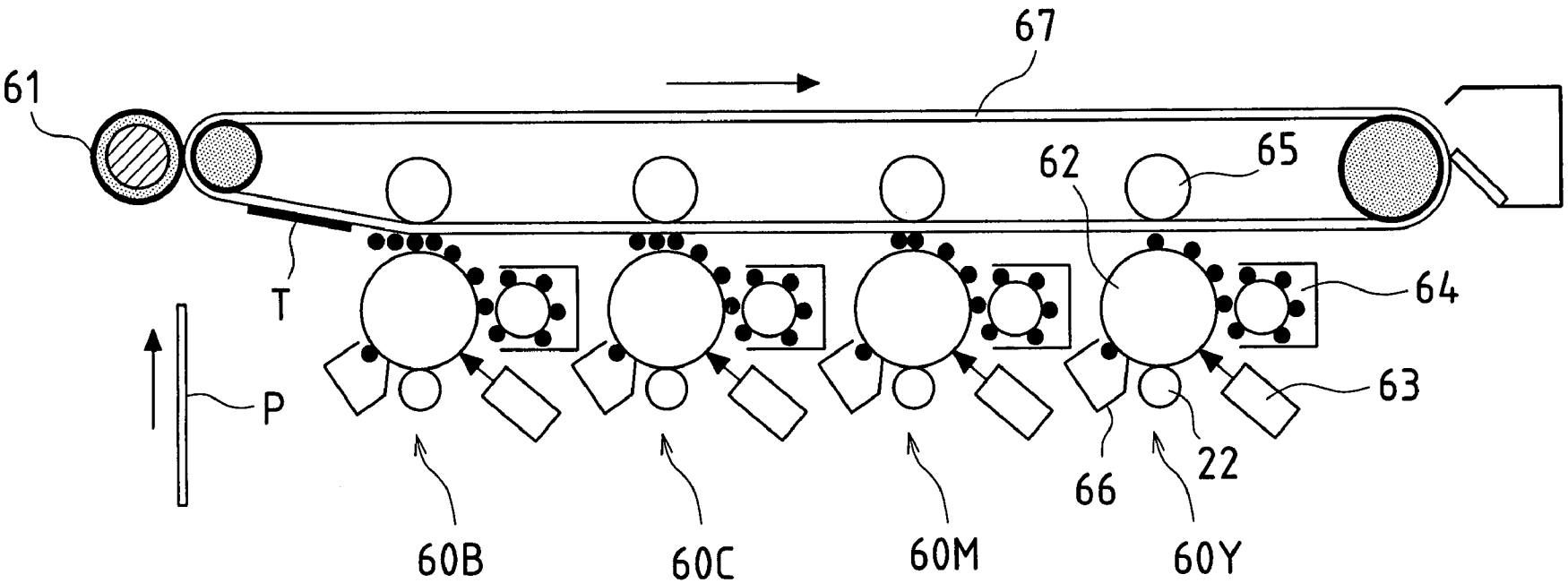
FIG. 9 is a schematic side view showing an Embodiment 2 of the image forming apparatus according to the present invention.

FIG. 9 is a schematic side view showing an image forming apparatus according to Embodiment 2 of the present invention. This image forming apparatus is used to form color images, being provided with four visible image forming units 60Y, 60M, 60C and 60B, and a transfer-fixing roller 61.

In each of the visible image forming units 60Y, 60M, 60C and 60B, a brush-based charging apparatus 22, laser scan unit 63, developing unit 64, transfer roller 65 and cleaner 66 are disposed around a photosensitive drum 62. The developing unit 64 of each of the visible image forming units 60Y, 60M, 60C and 60B contains toner of one of the colors yellow (Y), magenta (M), cyan (C) and black (B). Moreover, in the visible image forming units 60Y, 60M, 60C and 60B, once a uniform charge is applied to the surface of the photosensitive drum 62 by the brush-based charging apparatus 22, the laser beam of the laser scan unit 63 is modulated depending on the image information while the laser beam is shined onto the surface of the photosensitive drum 62, thus forming an electrostatic latent image on the surface of the photosensitive drum 62. The developing unit 64 adheres toner to the electrostatic latent image upon the surface of the photosensitive drum 62 and thus forms a toner image on the surface of the photosensitive drum 62. The transfer roller 65 to which is applied a bias voltage of a polarity opposite that of the toner is used to transfer the toner image on the surface of the photosensitive drum 62 to an intermediate transfer belt 67.

Each of the visible image forming units 60Y, 60M, 60C and 60B forms a toner image in one of the colors upon the surface of the photosensitive drum 62, and the various-colored toner images are sequentially transferred to the intermediate transfer belt 67 such that they overlap. Thereby, a single color toner image T is formed upon the intermediate transfer belt 67. The transfer-fixing roller 61 transfers and fixes this color toner image T to the recording paper P.

In this color image forming apparatus, it is necessary to provide the same number of brush-based charging apparatuses 22 and photosensitive drums 62 as the number of toner colors, so if four colors are used, for example, then it is necessary to provide four sets of brush-based charging apparatus 22 and photosensitive drum 62. For this reason, were corona-discharge type charging apparatus to be used, large amounts of ozone would be generated, causing not only the acrid smell of ozone, but also the problem of deterioration of the photosensitive drum 62 due to ozone.

However, the brush-based charging apparatus 22 is the same as that of the image forming apparatus of FIG. 1, so the amount of ozone generated is extremely small.

Note that the present invention is in no way limited to the aforementioned embodiments but rather various modifications are possible. For example, where the brushes of the bristle-embedded layer 461 are given a crimp so as to be inclined at the peripheral surface of the charging brush 411, instead, the bristles of the bristle-embedded layer 461 may be provided radially with respect to the rotating shaft 431, and the peripheries of the charging brush 411 and photosensitive drum 21 may be moved in the same direction in their area of contact, thus making the circumferential speed of the charging brush 411 faster than that of the photosensitive drum 21. Thereby also, the bristles of the charging brush 411 are inclined so that their grain is in the direction of rotation of the surface of the photosensitive drum 21, and thus the bristles of the bristle-embedded layer 461 are inclined uniformly in the circumferential direction of the charging brush 411.

In addition, while the brush-based charging apparatus shown in FIG. 2 is used for the brush-based charging apparatus 22 in Embodiments 1 and 2, this is not a limitation. Thus, here follows a description of a brush-based charging apparatus according to Embodiment 3 made with reference to drawings. Note that this brush-based charging apparatus 22 according to Embodiment 3 is provided with the image forming apparatus shown in FIGS. 1 and 9. For this reason, only the brush-based charging apparatus 22 will be described in the following Embodiment 3 while other details of the constitution of the image forming apparatus will be omitted.

EMBODIMENT 3

Figure 10:
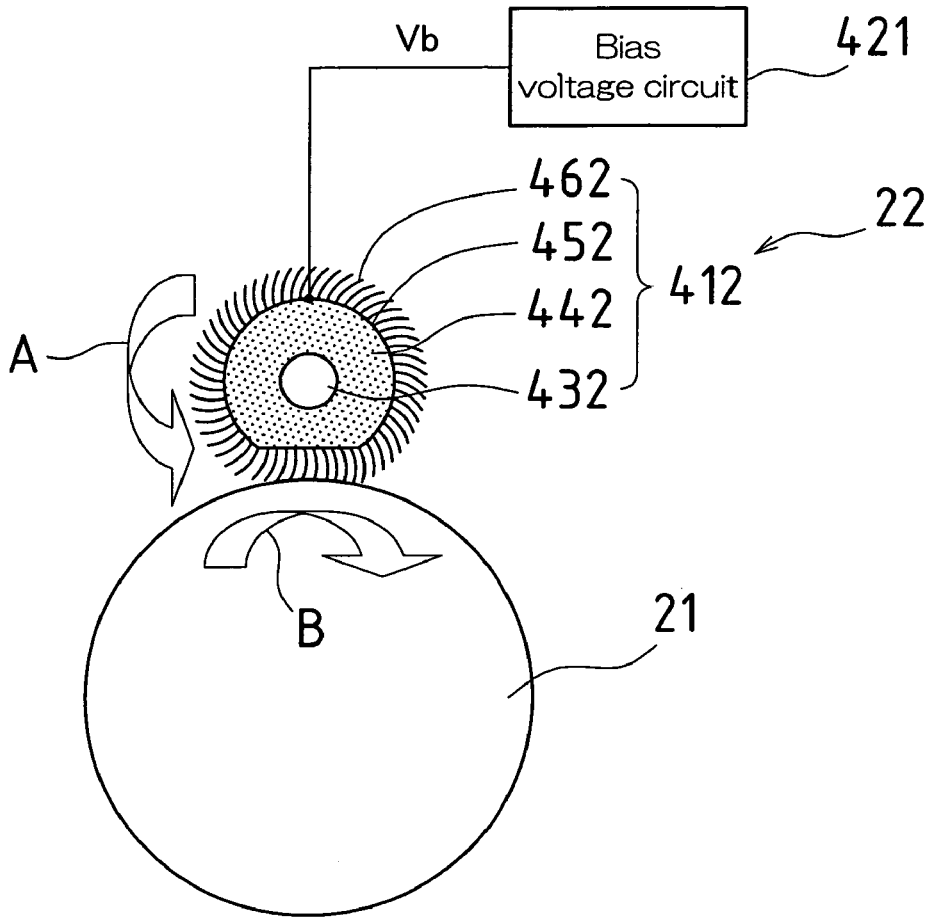
FIG. 10 is a side view showing a brush-based charging apparatus in the image forming apparatus of FIG. 1, as Embodiment 3.

FIG. 10 is a side view showing the brush-based charging apparatus 22. In this brush-based charging apparatus 22, the bias voltage $V_b$ of a bias voltage circuit 422 is applied to a rotatable brush 412, and the rotatable brush 412 presses the surface of the photosensitive drum 21 while the rotatable brush 412 and photosensitive drum 21 are rotated in the respective directions indicated by the arrows A and B at the same circumferential speed, and thus a charge is applied to the surface of the photosensitive drum 21.

The rotatable brush 412 includes a rotating shaft 432 around which is provided elastic material 442. The rotating shaft 432 and elastic material 442 are disposed concentrically and the elastic material 442 is covered by a tube 452, and moreover brush cloth 462 is applied around the tube 452. The rotating shaft 432 is made of metal, and the elastic material 442, tube 452 and brush cloth 462 are conductive. Accordingly, the bias voltage $V_b$ of the bias voltage circuit 422 can be applied to the brush cloth 462 through the rotating shaft 432, elastic material 442 and tube 452.

The bias voltage $V_b$ applied by the bias voltage circuit 422 to the rotatable brush 412 may be a DC voltage or a DC voltage overlaid with an AC voltage.

When a DC bias voltage $V_b$ is used, the amount of ozone generated may be reduced.

In addition, when a bias voltage $V_b$ consisting of overlaid DC and AC voltage is used, while the amount of ozone generated increases, it is possible to suppress unevenness in the charge on the surface of the photosensitive drum 21. This is because even when a rapid injection of charge occurs from the tip of a bristle of the rotatable brush 412 to the photosensitive drum 21, the midsections of the other bristles of the rotatable brush 412 make contact with the location of the rapid injection of charge, and the excess charge in this location is discharged due to the application of AC voltage from the other bristles, thus causing the potential at this location to become equal to the potential of the surroundings. The amplitude voltage of the AC voltage is preferably about twice the DC voltage or greater.

Figure 11:
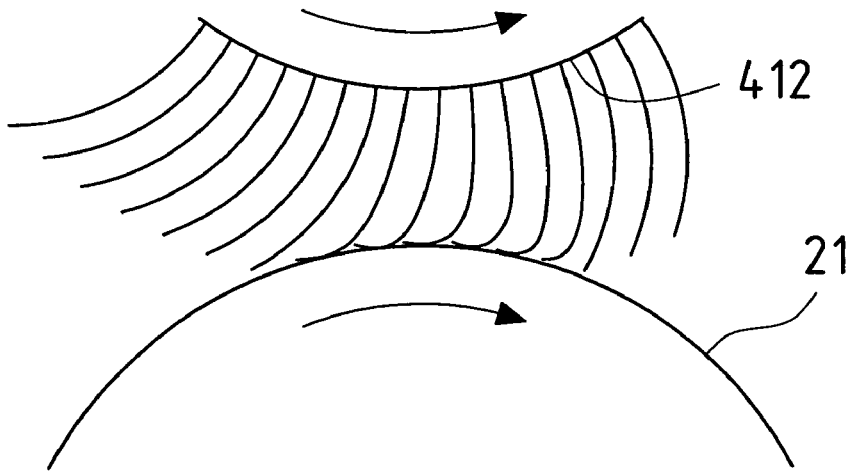
FIG. 11 is an enlarged side view showing the state of contact between the charging brush and the photosensitive drum in the brush-based charging apparatus of FIG. 10.

Here, when the rotatable brush 412 presses the surface of the photosensitive drum 21 while the rotatable brush 412 and photosensitive drum 21 are rotated in the respective directions indicated by the arrows A and B at the same circumferential speed, in the area of contact between the rotatable brush 412 and the photosensitive drum 21, the periphery of the rotatable brush 412 and the periphery of the photosensitive drum 21 are both moving in the same direction at the same speed. The bristles of the rotatable brush 412 have their orientation of inclination set so that their grain is in the direction of rotation of the surface of the photosensitive drum 21. For this reason, as shown in FIG. 11, the tips of the bristles of the rotatable brush 412 do not strike the surface of the photosensitive drum 21 straight on, but rather the midsections of the bristles of the rotatable brush 412 glide over the surface of the photosensitive drum 21. Moreover, the rotatable brush 412 contacts only the photosensitive drum 21 and does not make contact with other objects.

Thereby, disturbance of the rotatable brush 412 due to the tips of its bristles striking the surface of the photosensitive drum 21 straight on is prevented, and the bristles of the rotatable brush 412 glide over the surface of the photosensitive drum 21 and stream in the direction of the periphery of the rotatable brush 412, so the bristles of the rotatable brush 412 are constantly aligned in the peripheral direction.

If the bristles of the rotatable brush 412 are constantly aligned in the peripheral direction in this manner, then no disturbances in the lie of the bristles will be reflected as uneven charging of the surface of the photosensitive drum 21, so the surface of the photosensitive drum 21 will be uniformly charged. Were any disturbances in the lie of the bristles of the rotatable brush to occur, the disturbances in the lie of bristles would be reflected as uneven charging of the surface of the photosensitive drum 21.

In addition, the tips of the bristles of the rotatable brush 412 do not strike the surface of the photosensitive drum 21 straight on, so no rapid injection of charge occurs from the tips of bristles of the rotatable brush 412 to the photosensitive drum 21, and thus no unevenness in the charge in the surface of the photosensitive drum 21 due to such rapid injection of charge occurs. Were the tips of the bristles of the rotatable brush to strike the surface of the photosensitive drum 21 straight on, a rapid injection of charge would occur from the tips of bristles of the rotatable brush to the surface of the photosensitive drum 21, causing unevenness in the charge on the surface of the photosensitive drum 21.

FIG. 5(*a*) and FIG. 5(*b*) are diagrams illustrating a comparison between a gray image 4A with a certain grayscale level recorded in the state wherein the bristles of the rotatable brush 412 glide along the surface of the photosensitive drum 21 as in this embodiment, and a gray image 4B with a certain grayscale level recorded in the state wherein the bristles of the rotatable brush strike the surface of the photosensitive drum 21 straight on. As is clear from this comparison, where the gray image 4A according to this embodiment has a uniform grayscale level, a large number of lines appear in gray image 4B. This occurs because the tips of the bristles of the rotatable brush strike the surface of the photosensitive drum 21 straight on so that charge is injected rapidly from the bristle tips, causing linear unevenness in the charge on the surface of the photosensitive drum 21.

In addition, when the tips or midsections of the bristles of the rotatable brush 412 glide over the surface of the photosensitive drum 21, the mechanical resistance between the rotatable brush 412 and the photosensitive drum 21 is low so the bristles of the rotatable brush 412 and the surface of the photosensitive drum 21 are not readily worn. In addition, the mechanical resistance between the rotatable brush 412 and the photosensitive drum 21 is low so there is no need to increase the torque to the photosensitive drum 21. For this reason, any unevenness in rotation that may arise from increased torque to the photosensitive drum 21 does not occur, and the banding 4C (band-shaped image defects) as shown in FIG. 6 also does not occur.

Moreover, because elastic material 442 is provided around the rotating shaft 432, when the rotatable brush 412 is pressed against the photosensitive drum 21, not only the bristles of the rotatable brush 412 but also the elastic material 442 also deforms elastically. Because of this elastic deformation of the elastic material 442, the bristles of the rotatable brush 412 deform more flexibly and contact the surface of the photosensitive drum 21 more uniformly than when no elastic material 442 is present. Thereby, the surface of the photosensitive drum 21 is charged more evenly.

In addition, because the strip-shaped brush cloth 462 is wound in a spiral manner, the seams in the strip-shaped brush cloth 462 are spiral in shape. For this reason, when the bristles of the rotatable brush 412 are put in contact with the photosensitive drum 21 with the rotatable brush 412 and PS rollers 12 rotating, the effects of the seams in the brush cloth 462 do not readily appear in the surface of the photosensitive drum 21.

Alternately, in the state in which the rotatable brush 412 is pressed against the photosensitive drum 21, the density of bristles becomes lower at the spiral-shaped seam, and this is thought to become the cause of uneven charging. However, the bristles of the rotatable brush 412 deform flexibly due to elastic deformation of the elastic material 442 in the state in which the rotatable brush 412 is pressed against the photosensitive drum 21, so the bristles in the periphery of the spiral-shaped seams come closer, causing the density of bristles to be higher and the bristles of the rotatable brush 412 to achieve uniform contact with the surface of the photosensitive drum 21, so the surface of the photosensitive drum 21 is uniformly charged.

Moreover, not only the bristles of the rotatable brush 412 but also the elastic material 442 also deforms elastically so the pressure of the plurality of bristles making contact with the surface of the photosensitive drum 21 becomes more uniform, thus preventing disturbances in the lie of the bristles. Thereby, a uniform charge continues to be maintained on the surface of the photosensitive drum 21.

In addition, the bristles of the rotatable brush 412 and the elastic material 442 deform together, so the load on the bristles of the rotatable brush 412 is lessened, reducing the chances of crimping of the bristles of the rotatable brush 412. Even if the bristles of the rotatable brush 412 become crimped, recovery from this crimping occurs faster. Were there no elastic material 442, this recovery from crimping may take half a day, but if the elastic material 442 is present, this recovery from crimping takes less than 10 minutes.

Moreover, the tube 452 is interposed between the brush cloth 462 and the elastic material 442, so any developer that may be picked up from the surface of the photosensitive drum 21 by the brush cloth 462 and become attached to the bristles of the brush cloth 462 is blocked by the tube 452 and prevented from intruding into the elastic material 442.

Were there no tube 452, developer attached to the bristles of the brush cloth 462 would intrude into the elastic material 442, eliminating the elasticity of the elastic material 442, so the function and meritorious effects due to the elasticity of the elastic material 442 described above would not be achieved.

Figure 12:
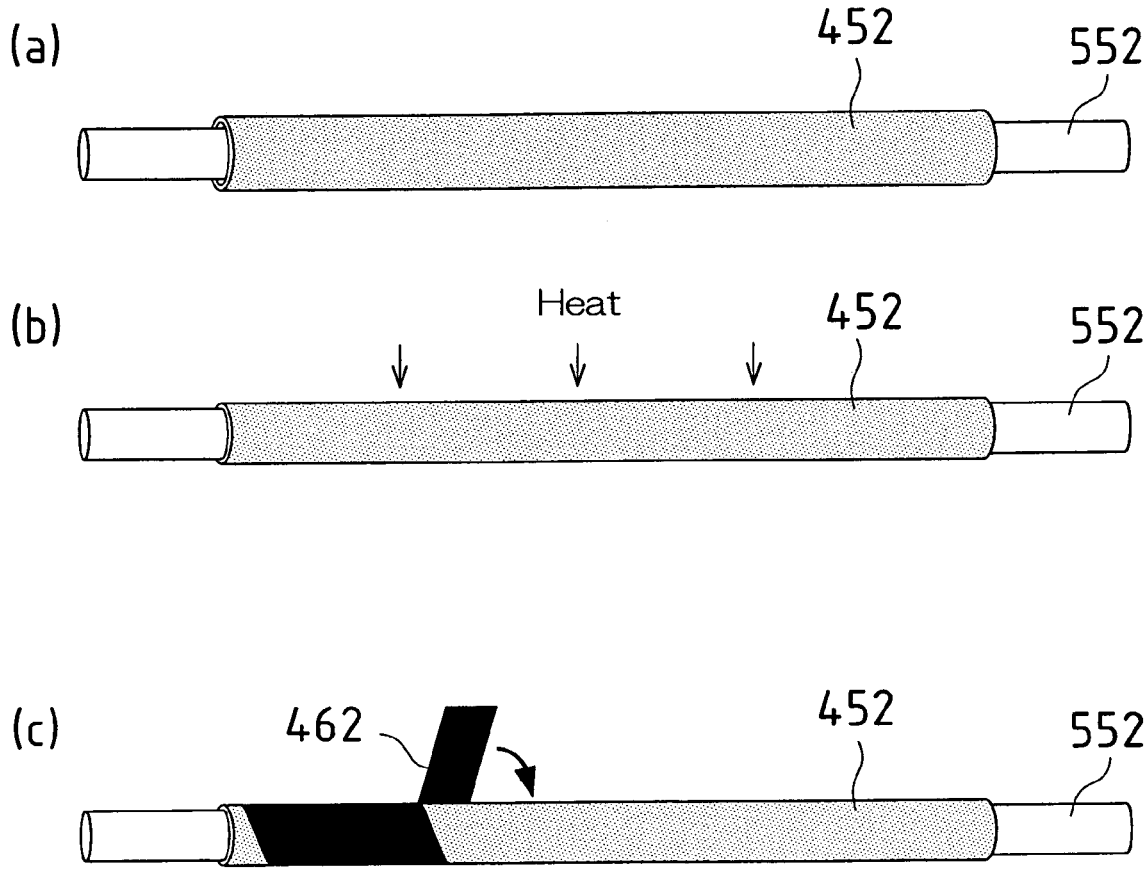
FIG. 12(*a*) through FIG. 12(*c*) are diagrams illustrating the manufacturing process for the rotatable brush in the brush-based charging apparatus of FIG. 10.
Figure 13:
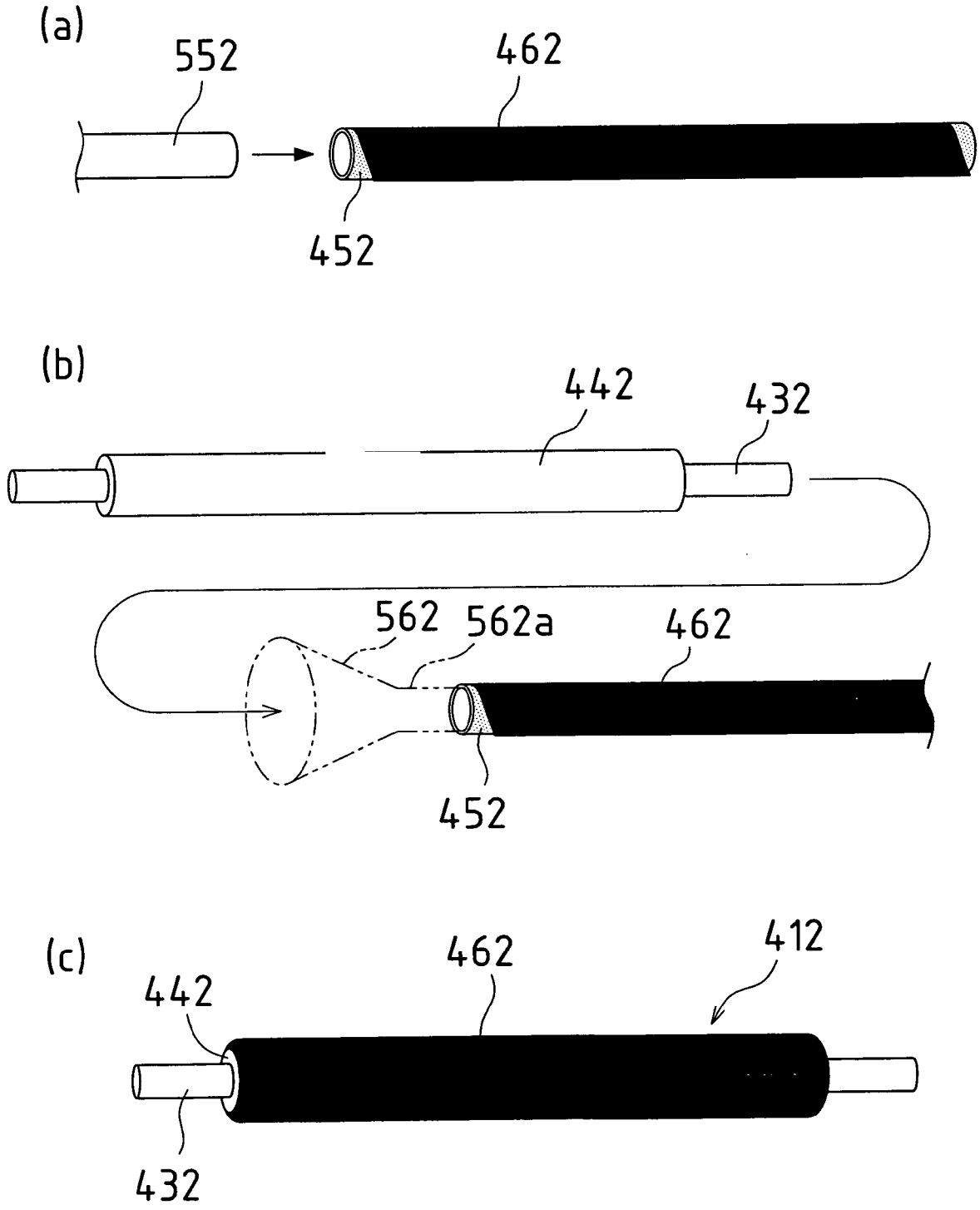
FIG. 13(*a*) through FIG. 13(*c*) are diagrams illustrating the manufacturing process in continuation from FIG. 12.

Here follows a description of a method for manufacturing the rotatable brush 412 made with reference to FIG. 12 and FIG. 13.

First, as shown in FIG. 12(*a*), a metal shaft 552 with an outside diameter slightly smaller than the inside diameter of the tube 452 is inserted into the interior of the conductive tube 452. Then, as shown in FIG. 12(*b*), the tube 452 is heated to cause heat shrinkage, thus tightly adhering the tube 452 to the metal shaft 552, so that the metal shaft 552 maintains the cylindrical shape of the tube 452. Accordingly, the tube 452 has the property of heat shrinkage. The thickness of the tube 452 may be roughly 100 μm–200 μm, for example.

Next, as shown in FIG. 12(*c*), after the tube 452 is coated with conductive adhesive (not shown), it is spirally wrapped with conductive brush cloth 462 cut into strips. At this time, the tube 452 is kept in a cylindrical shape, so the brush cloth 462 is also kept wrapped in a cylindrical shape.

Thereafter, as shown in FIG. 13(*a*), the tube 452 is removed from the metal shaft 552.

On the other hand, as shown in FIG. 13(*b*), the periphery of a metal rotating shaft 432 is coated with elastic material 442. The elastic material 442 includes conductive sponge or foam resin made of synthetic resin or the like, with an outside diameter larger than the inside diameter of the tube 452. Thus, the exit side of a neck 562*a* of a funnel-shaped jig 562 is fitted into the tube 452, and the elastic material 442 is passed through the neck 562*a* of the funnel-shaped jig 562, so that the elastic material 442 is compacted while being inserted into the inside of the tube 452, and thus the elastic material 442 is pressed into the inside of the tube 452. At this time, the outside diameter of the elastic material 442 is greater than the inside diameter of the tube 452, so the elastic material 442 expands inside the tube 452, causing the elastic material 442 to be tightly adhered to the tube 452.

Next, as shown in FIG. 13(*c*), the elastic material 442, tube 452 and brush cloth 462 are cut evenly at both ends to form a rotatable brush 412.

Note that both ends of the tube 452 may be made to extend longer than both ends of the elastic material 442, and after cutting only both ends of the brush cloth 462, the tube 452 may be subjected to heat shrinkage again so that it is tightly adhered to the rotating shaft 432. In this case, the elastic material 442 can be sealed to prevent the intrusion of moisture or the like.

Finally, the rotatable brush 412 is placed in a cylinder (not shown) and with the rotatable brush 412 rotating with the bristles of the rotatable brush 412 in contact with the inside wall surface of the cylinder, the inside of the cylinder is heated to thus align the bristles of the rotatable brush 412 in one direction. This applies a crimp so that each bristle of the rotatable brush 412 is inclined. Alternately, the rotating shaft 432 may be rotated while the bristles of the brush cloth 462 are heated while being pressed against a flat surface to give a crimp to the bristles of the brush cloth 462.

With such a manufacturing method, the elastic material 442 around the rotating shaft 432 is inserted into the inside of the tube 452, so the elastic material 442 is uniformly tightened by the tube 452. For this reason, the surface of the elastic material 442 assumes a smooth cylindrical shape and the contour surface of the rotatable brush 412 also assumes a smooth cylindrical shape. Thereby also, the bristles of the rotatable brush 412 will make uniform contact with the photosensitive drum 21, so it is possible to apply a uniform charge to the surface of the photosensitive drum 21.

Were the brush cloth 462 to be wound directly onto the elastic material 442 around the rotating shaft 432, the elastic material 442 would elastically deform during winding with the brush cloth 462, causing concavity and convexity in the surface of the elastic material 442, and concavity and convexity in the contour surface of the rotatable brush 412 also. In this case, the bristles of the rotatable brush 412 would not make uniform contact with the photosensitive drum 21, so achieving a uniform charge on the surface of the photosensitive drum 21 would become impossible.

In addition, the elastic material 442 around the rotating shaft 432 is pressed into the inside of the tube 452, so the elastic material 442 is tightly adhered to the tube 452. Thus, there is no need for the tube 452 to be adhered to the elastic material 442 with adhesive.

Were the tube 452 to be adhered to the elastic material 442 with adhesive, the adhesive would be absorbed into the fine concavity and convexity in the surface of the elastic material 442, so adequate adhesive strength would not be obtained. Were large amounts of adhesive to be used, the absorption of adhesive on the surface of the elastic material 442 would eliminate the elasticity of the elastic material 442, so the function and meritorious effects due to the elasticity of the elastic material 442 described above would not be achieved.

Figure 14:
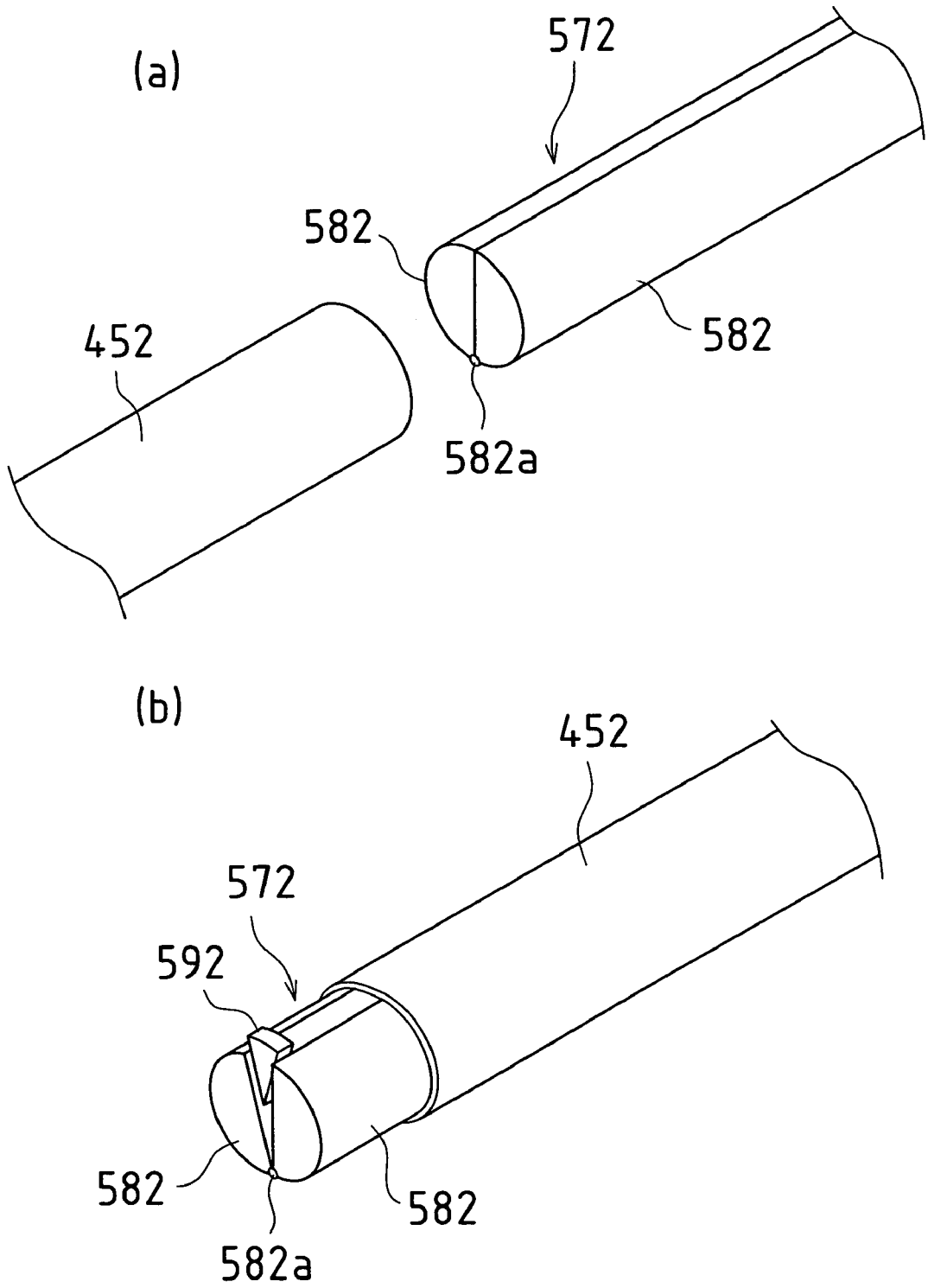
FIG. 14(*a*) and FIG. 14(*b*) are diagrams illustrating a modification of the rotatable brush manufacturing process.

Note that a tube 452 that does not have the property of heat shrinkage may also be used. In this case, the metal shaft 552 would be replaced with a cylindrical member having a variable outside diameter. For example, as shown in FIG. 14(*a*), a cylindrical member 572 made of a pair of semicylindrical members 582, 582 hinged to each other at their edges 582*a* may be used. In the state in which the semicylindrical members 582, 582 are closed, the outside diameter of the cylindrical member 572 is small so the cylindrical member 572 can be inserted into the inside of the tube 452. Thereafter, as shown in FIG. 14(*b*), a wedge 592 may be inserted between the semicylindrical members 582, 582 at either end, thus opening the semicylindrical members 582, 582 and increasing the outside diameter of the cylindrical member 572, so that the cylindrical member 572 is tightly adhered to the tube 452, and the cylindrical member 572 maintains the cylindrical shape of the tube 452. The brush cloth 462 is wound around the tube 452 in this state. Then, the wedges 592 at either end of the semicylindrical members 582, 582 are removed and the semicylindrical members 582, 582 are closed to make the outside diameter of the cylindrical member 572 small again, so the cylindrical member 572 can be removed from inside the tube 452.

Figure 15:
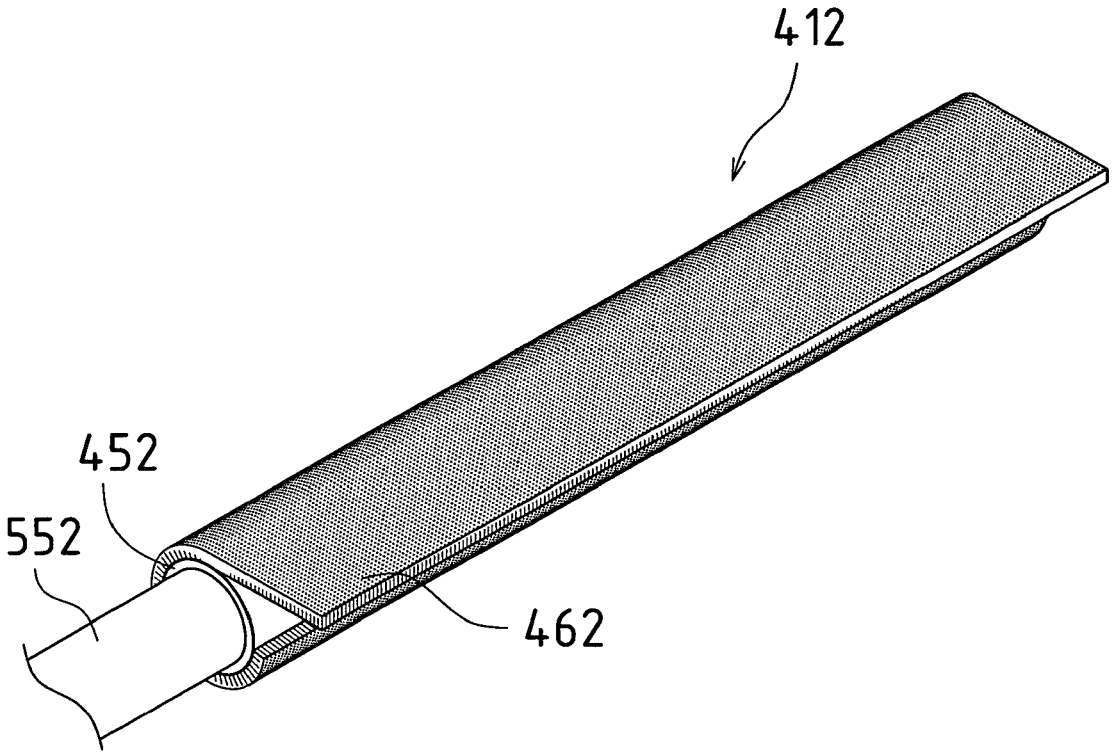
FIG. 15 is a perspective view showing another way of winding the brush cloth for the rotatable brush in the brush-based charging apparatus of FIG. 10.

In addition, rather than adhering the brush cloth 462 by spiral winding, the brush cloth 462 may also be adhered by wrapping the brush cloth 462 around the tube 452 in the same manner that cigarette paper is wrapped around a cigarette, as shown in FIG. 15. In this case, the bristles of the brush cloth 462 are oriented radially with respect to the rotating shaft 432, so the bristles of the brush cloth 462 are easily inclined to be aligned in the circumferential direction of the rotatable brush 412.

Note that the brush-based charging apparatus 22 is in no way limited to the aforementioned embodiments but may also be a brush-based charging apparatus according to Embodiment 4 below. Here follows a description of a brush-based charging apparatus according to Embodiment 4 made with reference to drawings. Note that this brush-based charging apparatus 22 according to Embodiment 4 is provided with the image forming apparatus shown in FIGS. 1 and 9. For this reason, only the brush-based charging apparatus 22 will be described in the following Embodiment 4 while other details of the constitution of the image forming apparatus will be omitted.

EMBODIMENT 4

Figure 16:
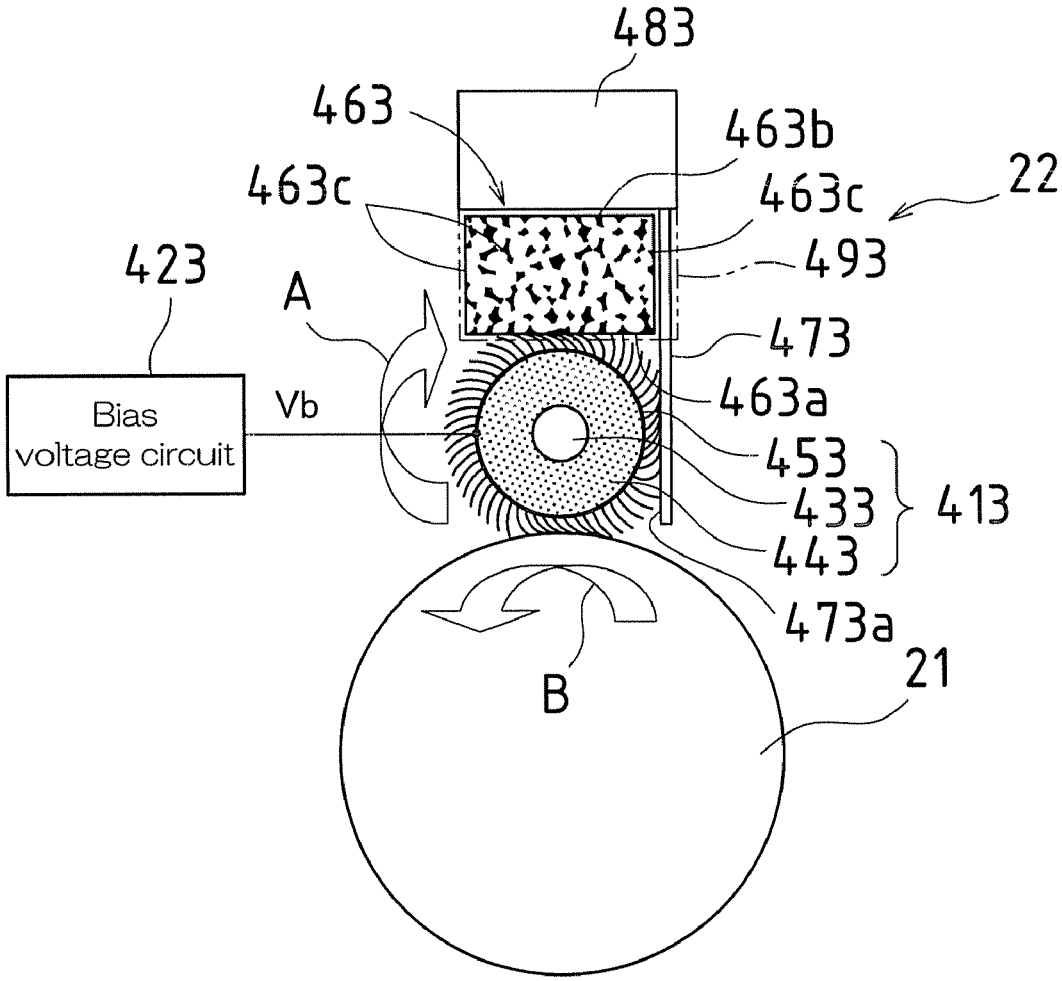
FIG. 16 is a side view showing a brush-based charging apparatus and cleaning apparatus in the image forming apparatus of FIG. 1, as Embodiment 4.

FIG. 16 is a side view showing the brush-based charging apparatus 22. In this brush-based charging apparatus 22, the bias voltage $V_b$ of a bias voltage circuit 423 is applied to a charging brush 413, and the charging brush 413 presses against the surface of the photosensitive drum 21 while the charging brush 413 and photosensitive drum 21 are rotated in the respective directions indicated by the arrows A and B at the same circumferential speed, and thus a charge is applied to the surface of the photosensitive drum 21.

The bias voltage $V_b$ applied by the bias voltage circuit 423 to the charging brush 413 may be a DC voltage or a DC voltage overlaid with an AC voltage.

When a DC bias voltage $V_b$ is used, the amount of ozone generated may be reduced.

In addition, when a bias voltage $V_b$ consisting of overlaid DC and AC voltage is used, while the amount of ozone generated increases, it is possible to suppress unevenness in the charge on the surface of the photosensitive drum 21. This is because even when a rapid injection of charge occurs from the tip of a bristle of the charging brush 413 to the photosensitive drum 21, the midsections of the other bristles of the charging brush 413 make contact with the location of the rapid injection of charge, and the excess charge in this location is discharged due to the application of AC voltage from the other bristles, thus causing the potential at this location to become equal to the potential of the surroundings. The amplitude voltage of the AC voltage is preferably about twice the DC voltage or greater.

Here, when the charging brush 413 presses against the surface of the photosensitive drum 21 while the charging brush 413 and photosensitive drum 21 are rotated in the respective directions indicated by the arrows A and B at the same circumferential speed, iii the area of contact between the charging brush 413 and the photosensitive drum 21, the periphery of the charging brush 413 and the periphery of the photosensitive drum 21 are both moving in the same direction at the same speed. The bristles of the charging brush 413 have their orientation of inclination set so that their grain is in the direction of rotation of the surface of the photosensitive drum 21. For this reason, the tips of the bristles of the charging brush 413 (equivalent to the charging brush 411 shown in FIG. 4) do not strike the surface of the photosensitive drum 21 straight on, but rather the midsections of the bristles of the charging brush 413 glide over the surface of the photosensitive drum 21.

Thereby, disturbance of the charging brush 413 due to the tips of its bristles striking the surface of the photosensitive drum 21 straight on is prevented, and the bristles of the charging brush 413 glide over the surface of the photosensitive drum 21 and stream in the direction of the periphery of the charging brush 413, so the bristles of the charging brush 413 are constantly aligned in the peripheral direction.

If the bristles of the charging brush 413 are constantly aligned in the peripheral direction in this manner, then no disturbances in the lie of the bristles will be reflected as uneven charging of the surface of the photosensitive drum 21, so the surface of the photosensitive drum 21 will be uniformly charged. Were any disturbances in the lie of the bristles of the rotatable brush to occur, the disturbances in the lie of bristles would be reflected as uneven charging of the surface of the photosensitive drum 21.

In addition, the tips of the bristles of the charging brush 413 do not strike the surface of the photosensitive drum 21 straight on, so no rapid injection of charge occurs from the tips of bristles of the charging brush 413 to the photosensitive drum 21, and thus no unevenness in the charge on the surface of the photosensitive drum 21 due to such rapid injection of charge occurs. Were the tips of the bristles of the rotatable brush to strike the surface of the photosensitive drum 21 straight on, a rapid injection of charge would occur from the tips of bristles of the rotatable brush to the surface of the photosensitive drum 21, causing unevenness in the charge on the surface of the photosensitive drum 21.

FIG. 5(*a*) and FIG. 5(*b*) are diagrams illustrating a comparison between a gray image 4A with a certain grayscale level recorded in the state wherein the bristles of the charging brush 413 glide along the surface of the photosensitive drum 21 as in this embodiment, and a gray image 4B with a certain grayscale level recorded in the state wherein the bristles of the rotatable brush strike the surface of the photosensitive drum 21 straight on. As is clear from this comparison, where the gray image 4A according to this embodiment has a uniform grayscale level, a large number of lines appear in gray image 4B. This occurs because the tips of the bristles of the rotatable brush strike the surface of the photosensitive drum 21 straight on so that charge is injected rapidly from the bristle tips, causing linear unevenness in the charge on the surface of the photosensitive drum 21.

In addition, when the tips or midsections of the bristles of the charging brush 413 glide over the surface of the photosensitive drum 21, the mechanical resistance between the charging brush 413 and the photosensitive drum 21 is low so the bristles of the charging brush 413 and the surface of the photosensitive drum 21 are not readily worn. In addition, the mechanical resistance between the charging brush 413 and the photosensitive drum 21 is low so there is no need to increase the torque to the photosensitive drum 21. For this reason, any unevenness in rotation that may arise from increased torque to the photosensitive drum 21 does not occur, and the banding 4C (band-shaped image defects) as shown in FIG. 6 also does not occur.

Moreover, because elastic material 443 is provided around the rotating shaft 433, when the charging brush 413 is pressed against the photosensitive drum 21, not only the bristles of the charging brush 413 but also the elastic material 443 also deforms elastically. Because of this elastic deformation of the elastic material 443, the bristles of the charging brush 413 deform more flexibly and contact the surface of the photosensitive drum 21 more uniformly than when no elastic material 443 is present. Thereby, the surface of the photosensitive drum 21 is charged more evenly.

Figure 17:
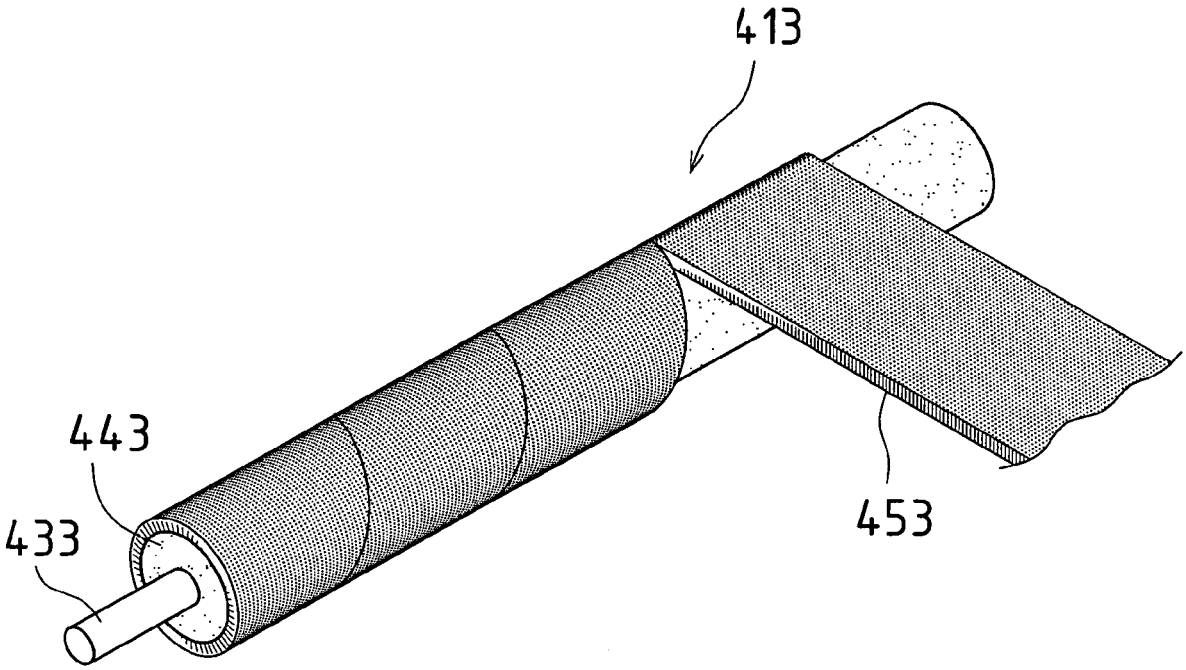
FIG. 17 is a perspective view showing another way of winding the brush cloth for the charging brush in the brush-based charging apparatus of FIG. 16.

In addition, as shown in FIG. 17, because the strip-shaped brush cloth 453 is wound in a spiral manner, the seams in the strip-shaped brush cloth 453 are spiral in shape. For this reason, when the bristles of the charging brush 413 are put in contact with the photosensitive drum 21 with the charging brush 413 and the photosensitive drum 21 rotating, the effects of the seams in the brush cloth 453 do not readily appear in the surface of the photosensitive drum 21.

Alternately, in the state in which the charging brush 413 is pressed against the photosensitive drum 21, the density of bristles becomes lower at the spiral-shaped seam, and this is thought to become the cause of uneven charging. However, the bristles of the charging brush 413 deform flexibly due to elastic deformation of the elastic material 443 in the state in which the charging brush 413 is pressed against the photosensitive drum 21, so the bristles in the periphery of the spiral-shaped seams come closer, causing the density of bristles to be higher and the bristles of the charging brush 413 to achieve uniform contact with the surface of the photosensitive drum 21, so the surface of the photosensitive drum 21 is uniformly charged.

Moreover, not only the bristles of the charging brush 413 but also the elastic material 443 also deforms elastically so the pressure of the plurality of bristles making contact with the surface of the photosensitive drum 21 becomes more uniform, thus preventing disturbances in the lie of the bristles. Thereby, a uniform charge continues to be maintained on the surface of the photosensitive drum 21.

In addition, the bristles of the charging brush 413 and the elastic material 443 deform together, so the load on the bristles of the charging brush 413 is lessened, reducing the chances of crimping of the bristles of the charging brush 413. Even if the bristles of the charging brush 413 become crimped, recovery from this crimping occurs faster. Were there no elastic material 443, this recovery from crimping may take half a day, but if the elastic material 443 is present, this recovery from crimping takes less than 10 minutes.

On the other hand, with such a brush-based charging apparatus 22, there is a drawback in that residual developer on the photosensitive drum 21 or other fouling material may adhere to the charging brush 413, thus fouling the charging brush 413. If this fouling of the charging brush 413 is left as is, this could cause uneven charging or even damage to the photosensitive drum 21, thus leading to degraded image quality.

To solve this problem, the brush-based charging apparatus 22 according to this embodiment is provided with a cleaning apparatus for the charging brush 413. In this cleaning apparatus, elastic foam material 463 is disposed above the charging brush 413, so the elastic foam material 463 presses against the bristles of the charging brush 413, thus removing any developer or fouling material or the like attached to the bristles of the charging brush 413. In addition, a slide plate 473 is disposed on the right-hand side of the charging brush 413, 50 the slide plate 473 presses against the bristles of the charging brush 413, thus aligning any bristles of the charging brush 413 that may have been disturbed by pressing the elastic foam material 463.

The elastic foam material 463 is positioned downstream in the direction of rotation of the charging brush 413 from the position of contact between the charging brush 413 and the photosensitive drum 21. In addition, the slide plate 473 is positioned downstream in the direction of rotation of the charging brush 413 from the elastic foam material 463. Accordingly, the bristles of the charging brush 413 contact the photosensitive drum 21 and apply a charge to the photosensitive drum 21 and then press the elastic foam material 463, and subsequently press the slide plate 473 before again contacting the photosensitive drum 21.

The bottom face of the elastic foam material 463 serves as a press face 463*a* (the contact face aspect of the present invention) that is pressed by the bristles of the charging brush 413. In addition, the top face of the elastic foam material 463 serves as a discharge face 463*b*, with this discharge face 463*b* covered by a developer vessel 483. The press face 463*a* and discharge face 463*b* of the elastic foam material 463 are both open. Moreover, each of the side faces 463*c* of the elastic foam material 463 is sealed by a casing 493.

The elastic foam material 463 is made of synthetic resin sponge, including single bubbles and connected bubbles. Single bubbles are bubbles that appear alone, unconnected to other bubbles. Connected bubbles refer to large numbers of bubbles connected to each other, so they can also be called a large number of small holes connected to each others. The press face 463*a*, discharge face 463*b* and side faces 463*c* of the elastic foam material 463 each has a large number of small holes (bubbles) present on it, and these small holes are connected to a large number of small holes (connected bubbles) within the elastic foam material 463.

The slide plate 473 is made of Teflon® or another fluoropolymer, having a smooth surface 473*a* with a low friction coefficient.

With a cleaning apparatus having such a constitution, as the charging brush 413 rotates, the brushes of the charging brush 413 are pressed against the press face 463*a* of the elastic foam material 463. At this time, the press face 463*a* of the elastic foam material 463 reaches near the base of the plurality of bristles of the charging brush 413. Thus, the small holes in the press face 463*a* of the elastic foam material 463 remove any developer or other fouling material adhering to the plurality of brushes of the charging brush 413, and the developer or other fouling material thus removed is transferred to the small holes in the press face 463*a*, and thus the bristles of the charging brush 413 are cleaned from near their bases.

As this cleaning of the bristles of the charging brush 413 by the press face 463*a* of the elastic foam material 463 continues, the developer and other fouling material is continuously transferred to the small holes in the press face 463*a*, and when the small holes in the press face 463*a* become full, the developer and other fouling material within the small holes in the press face 463*a* enters and moves into the plurality of small holes (connected bubbles) within the elastic foam material 463. Moreover, the developer and other fouling material within the elastic foam material 463 eventually reaches the discharge face 463*b* or the side faces 463*c* of the elastic foam material 463. The developer and other fouling material reaching the discharge face 463*b* of the elastic foam material 463 is discharged as is into the developer vessel 483 and recovered. In addition, the developer and other fouling material reaching the side faces 463*c* of the elastic foam material 463 avoids the side faces 463*c* because the side faces 463*c* are sealed with the casing 493, and thus continues moving toward the discharge face 463*b*, ultimately reaching the discharge face 463*b* and being discharged into the developer vessel 483 and recovered.

Accordingly, as the charging brush 413 rotates, developer and other fouling material adhering to the bristles of the charging brush 413 is removed by the press face 463*a* of the elastic foam material 463, the developer and other fouling material passes through the interior of the elastic foam material 463 and moves into the developer vessel 483 and is recovered.

Continuing on, as the charging brush 413 rotates, the bristles of the charging brush 413 are pressed against the smooth surface 473*a* of the slide plate 473. At this time also, the smooth surface 473*a* of the slide plate 473 again reaches near the base of the plurality of bristles of the charging brush 413.

The smooth surface 473*a* of the slide plate 473 has an extremely low friction coefficient, so the bristles of the charging brush 413 are aligned in the circumferential direction without damaging or pulling out the bristles of the charging brush 413. It is thus possible to prevent uneven charging of the surface of the photosensitive drum 21 caused by disorder in the orientation of the bristles of the charging brush 413.

In this manner, with this embodiment, the bristles of the charging brush 413 press the elastic foam material 463 and any developer or other fouling material adhering to the bristles of the charging brush 413 is removed, and the bristles of the charging brush 413 which are disturbed at this time then press the slide plate 473, where the bristles of the charging brush 413 are aligned in a certain direction. It is thus possible to prevent uneven charging of the surface of the photosensitive drum 21 caused by developer or other fouling material adhering to the bristles of the charging brush 413, and keep uneven charging of the surface of the photosensitive drum 21 caused by disorder in the orientation of the bristles of the charging brush 413 from occurring.

Figure 18:
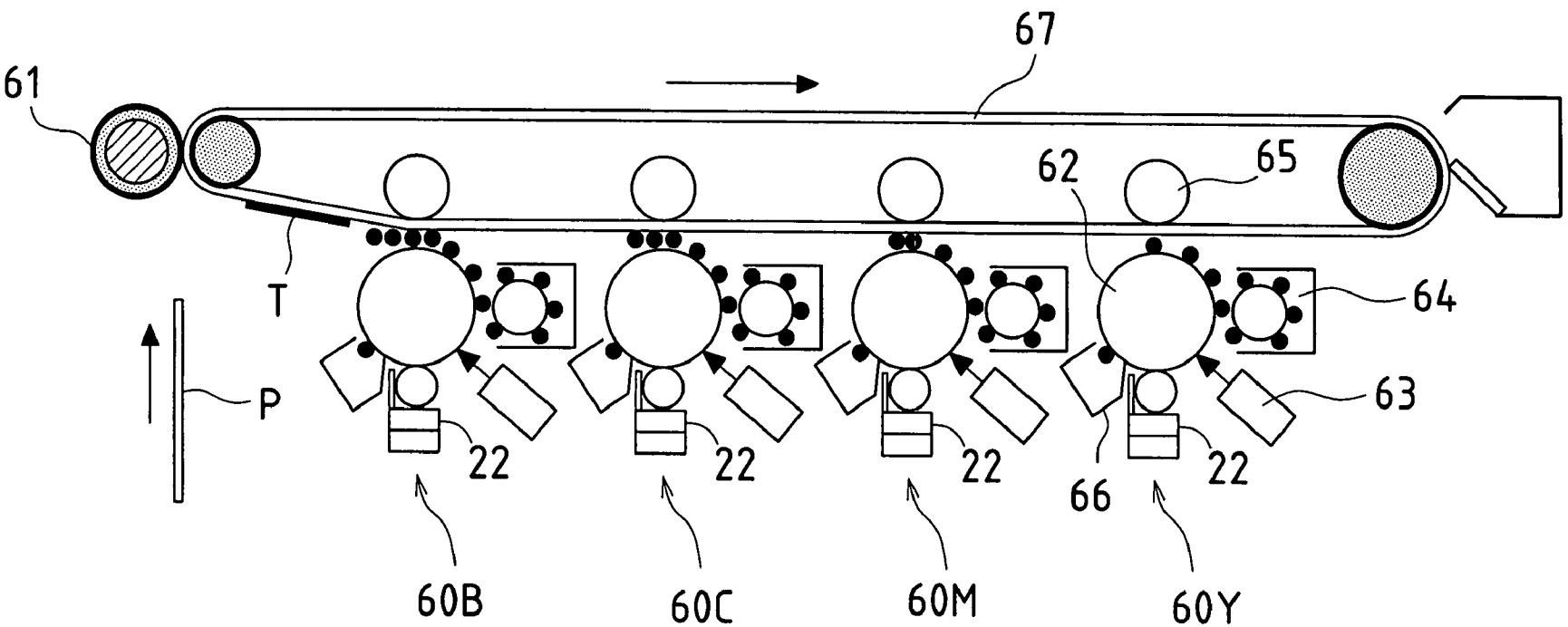
FIG. 18 is a schematic side view showing an image forming apparatus according to another mode of Embodiment 4.

Note that if the brush-based charging apparatus 22 according to this Embodiment 4 is applied to the image forming apparatus illustrated in Embodiment 2 (see FIG. 9), the image forming apparatus would have the constitution illustrated in FIG. 18. With this Embodiment 4 as shown in FIG. 18, the brush-based charging apparatus 22 is disposed below the photosensitive drum 62, so developer and other fouling material from the charging brush 413 does not go against the force of gravity and is removed by the small holes of the elastic foam material 463, and thus developer and other fouling material passes through the small holes in the elastic foam material 463 and flows downward toward the discharge face 463*b* below, and can be discharged into the developer vessel 483, thereby increasing the efficiency of removal of fouling material.

Figure 19:
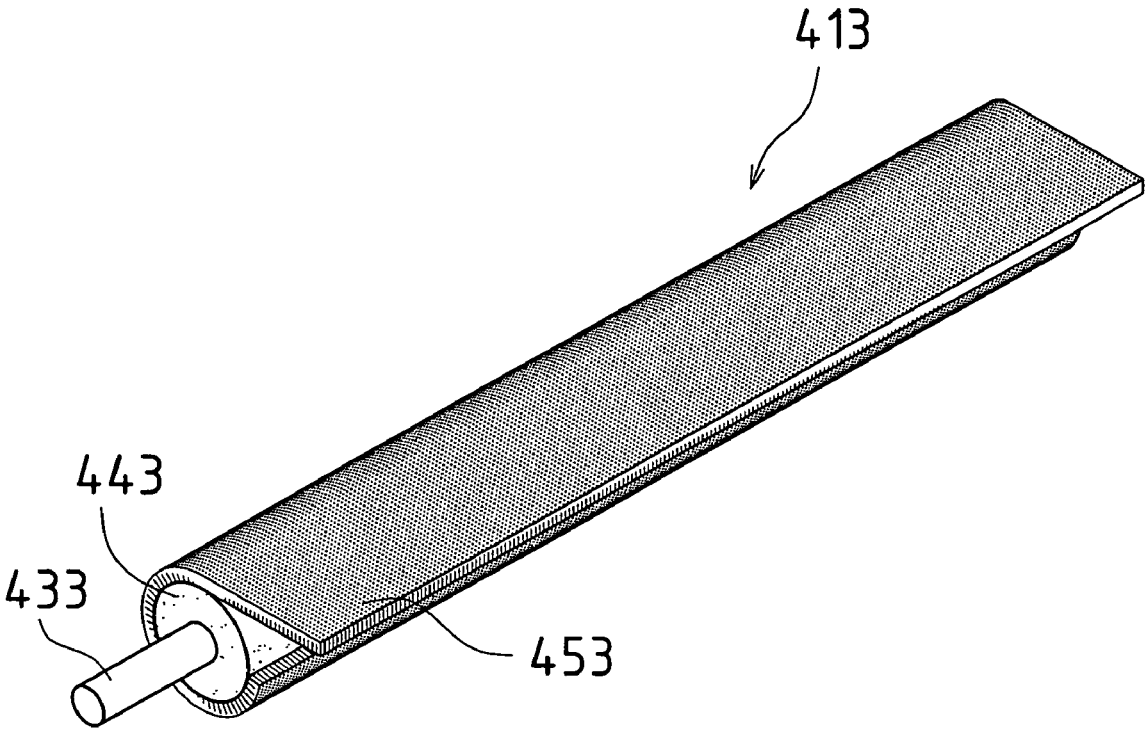
FIG. 19 is a perspective view showing another way of winding the brush cloth for the rotatable brush in the brush-based charging apparatus of FIG. 16.

In addition, rather than adhering the brush cloth 453 by spiral winding, as shown in FIG. 19, the brush cloth 453 may also be adhered by wrapping round the elastic material 443 in the same manner that cigarette paper is wrapped around a cigarette. In this case, the bristles of the brush cloth 453 are oriented radially with respect to the rotating shaft 433, so the bristles of the brush cloth 453 are easily inclined to be aligned in the circumferential direction of the charging brush 413.

Note that the rotatable brush according to the present invention can be applied not only to the charging brush of a brush-based charging apparatus, but also to the cleaning brush of a cleaning unit, discharge brush of a discharge unit and the like in an image forming apparatus, and moreover it may be applied to any rotatable brush regardless of the structure of the rotatable brush.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A cleaning apparatus for a rotatable brush that contacts upon or slides along a carrier of electrostatic latent images in order to apply an electric potential to the carrier of the electrostatic latent images, comprising:

an elastic foam body pressed by the bristles of the rotating brush provided downstream in a direction of a rotation of the rotating brush from a position of contact with the carrier of the electrostatic latent images, and a slide member pressed by the bristles of the rotating brush downstream in the direction of the rotation of the rotating brush from the elastic foam body, wherein the elastic foam body has a contact face that presses the rotatable brush, a discharge face that discharges developer or the like that enters the elastic foam body, and all faces other than the contact face and the discharge face are sealed.

2. The cleaning apparatus for a rotatable brush according to claim 1 wherein the slide member has a smooth surface so that the orientations of the bristles of the rotatable brush are aligned by the bristles of the rotatable brush pressing this smooth surface.

3. The cleaning apparatus for a rotatable brush according to claim 1 wherein the elastic foam body is an elastic foam body with connected bubbles.

4. The cleaning apparatus for a rotatable brush according to claim 1 wherein the rotatable brush contacts the bottom surface of the carrier of the electrostatic latent images.

* * * * *